US007759036B2

(12) United States Patent
Utsumi et al.

(10) Patent No.: US 7,759,036 B2
(45) Date of Patent: Jul. 20, 2010

(54) TONER AND PRODUCTION METHOD THEREOF, IMAGE FORMING APPARATUS AND IMAGE FORMING METHOD, AND PROCESS CARTRIDGE

(75) Inventors: Tomoko Utsumi, Ebina (JP); Satoshi Mochizuki, Numazu (JP); Hideki Sugiura, Fuji (JP); Tomoyuki Ichikawa, Kawasaki (JP); Minoru Masuda, Numazu (JP); Shinya Nakayama, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 523 days.

(21) Appl. No.: 11/573,251

(22) PCT Filed: Aug. 4, 2005

(86) PCT No.: PCT/JP2005/014709

§ 371 (c)(1), (2), (4) Date: May 9, 2007

(87) PCT Pub. No.: WO2006/014019

PCT Pub. Date: Feb. 9, 2006

(65) Prior Publication Data

US 2008/0096116 A1 Apr. 24, 2008

(30) Foreign Application Priority Data

Aug. 5, 2004 (JP) ..... 2004-229201

(51) Int. Cl.
*G03G 15/10* (2006.01)

(52) U.S. Cl. ..... 430/108.1; 430/108.6; 430/108.7; 430/110.1; 430/110.2; 430/110.3

(58) Field of Classification Search ..... 430/108.1, 430/108.6, 108.7, 110.1, 110.2, 110.3
See application file for complete search history.

(56) References Cited

U.S. PATENT DOCUMENTS

| | | | | |
|---|---|---|---|---|
| 4,740,443 | A | 4/1988 | Nakahara et al. | |
| 5,770,342 | A | 6/1998 | Okae et al. | |
| 5,783,352 | A | 7/1998 | Okae et al. | |
| 6,403,271 | B1 | 6/2002 | Suzuki et al. | |
| 6,479,206 | B1 | 11/2002 | Suzuki et al. | |
| 6,489,075 | B2 | 12/2002 | Suzuki et al. | |
| 2002/0048473 | A1* | 4/2002 | Yamada et al. | 399/350 |
| 2003/0104296 | A1 | 6/2003 | Hirokazu | |
| 2003/0190543 | A1 | 10/2003 | Sugiura et al. | |
| 2004/0058267 | A1* | 3/2004 | Ishiyama et al. | 430/110.2 |
| 2004/0091806 | A1* | 5/2004 | Qian et al. | 430/109.31 |
| 2004/0142265 | A1* | 7/2004 | Tomita et al. | 430/108.4 |
| 2004/0259017 | A1* | 12/2004 | Shibai et al. | 430/137.1 |
| 2005/0095516 | A1* | 5/2005 | Ohmura et al. | 430/45 |
| 2005/0191575 | A1 | 9/2005 | Sugiura et al. | |

FOREIGN PATENT DOCUMENTS

| | | | |
|---|---|---|---|
| EP | 1 273 977 A1 | | 1/2003 |
| JP | 62 205366 | | 9/1987 |
| JP | 4 182659 | | 6/1992 |
| JP | 4 307558 | | 10/1992 |
| JP | 5 66612 | | 3/1993 |
| JP | 5 107808 | | 4/1993 |
| JP | 6 170214 | | 6/1994 |
| JP | 7-114211 | | 5/1995 |
| JP | 7 191495 | | 7/1995 |
| JP | 7 333887 | | 12/1995 |
| JP | 8 44111 | | 2/1996 |
| JP | 9 179411 | | 7/1997 |
| JP | 09211895 | * | 8/1997 |
| JP | 2000 122347 | | 4/2000 |
| JP | 2000 267331 | | 9/2000 |
| JP | 2000 310882 | | 11/2000 |
| JP | 2001-66820 | | 3/2001 |
| JP | 2001 281928 | | 10/2001 |
| JP | 2001 312191 | | 11/2001 |
| JP | 2002 23408 | | 1/2002 |
| JP | 2002 108001 | | 4/2002 |
| JP | 2002 311775 | | 10/2002 |
| JP | 2002-318467 | | 10/2002 |
| JP | 2003 215837 | | 7/2003 |

(Continued)

OTHER PUBLICATIONS

Abstract of JP 09211895 Aug. 1995.*

(Continued)

*Primary Examiner*—Hoa V Le
(74) *Attorney, Agent, or Firm*—Oblon, Spivak, McClelland, Maier & Neustadt, L.L.P.

(57) ABSTRACT

The object of the invention is to provide a toner enabling excellent transferring properties, cleanability, and fixability and forming a high-precision image without substantially degraded image quality even after printed on a number of sheets of paper. The invention also provides the toner-production method, an image forming apparatus, an image forming method, and a process cartridge. To this end, the present invention provides a toner which comprises toner-base particles containing a binder resin and a filler, and inorganic fine particles, in which the filler is included in a filler-layer in the vicinity of surfaces of the toner-base particles, the number average particle diameter of the primary particles of the inorganic fine particles is 90 nm to 300 nm, and the average circularity of the toner is 0.95.

28 Claims, 5 Drawing Sheets

FOREIGN PATENT DOCUMENTS

| | | |
|---|---|---|
| JP | 2004 45668 | 2/2004 |
| JP | 2004 53916 | 2/2004 |
| JP | 2004 125939 | 4/2004 |
| JP | 2004 144804 | 5/2004 |
| JP | 2004 177555 | 6/2004 |
| JP | 2004-212620 | 7/2004 |
| JP | 2004 212819 | 7/2004 |
| JP | 2004 086149 | 10/2004 |

OTHER PUBLICATIONS

Machine English language translation of JP 09211895 Aug. 1997.*
U.S. Appl. No. 12/206,056, filed Sep. 8, 2008, Sugiura.

* cited by examiner

TONER AND PRODUCTION METHOD THEREOF, IMAGE FORMING APPARATUS AND IMAGE FORMING METHOD, AND PROCESS CARTRIDGE

TECHNICAL FIELD

The present invention relates to a toner used for image forming according to electrostatic copying process such as for copiers, facsimiles, printers, and the production method thereof, an image forming apparatus using the toner, an image forming method thereof, and a process cartridge.

BACKGROUND ART

An image forming process based on an electrophotographic process comprises charging a surface of an photoconductor which is a latent image carrier by means of an electric discharge; exposing the charged surface of the photoconductor to form a latent electrostatic image; developing the latent electrostatic image formed on the surface of the latent image carrier into a visible image by supplying a toner to the latent electrostatic image; transferring the toner image on the surface of the photoconductor onto the surface of a recording medium; fixing the toner image on the surface of the recording medium; and eliminating and cleaning the residual toner remaining on the surface of the image carrier after the transferring.

In recent years, there have been increasing demands for high-quality images, in particular, to realize forming a high-precision color image, smaller sizing of toner particle diameter i.e. making toner particle diameter smaller and toner particles in a spherical shape are under way. Toner particles formed in smaller diameter enable excellent dot-reproductivity, and a spherically formed toner enables improving developing properties and transferring properties. Since it is very difficult to produce such a smaller-particle-sized and spherically formed toner by a conventional kneading and grinding method, there is a growing adoption of a polymerized toner produced by a suspension-polymerization method, an emulsion polymerization method, and a dispersion-polymerization method.

However, when a toner particle diameter is sized down up to a few micrometers or less, non-electrostatic adherence such as van der Waals force or the like which works on between a toner and a photoconductor increases in proportion to its empty weight, and therefore, releasing properties degrade, which results in degraded transferring properties and cleanability, and the like.

On the other hand, a toner rounded and formed in a shape close to a perfect sphere enables a high transferring rate, because such a toner has a lower adherence with a photoconductor or the like lower than that of a toner formed in an indefinite or undetermined shape which can be obtained by a kneading and grinding method, and therefore the toner has an excellent releasing properties and is moderately released from a photoconductor. Besides, a spherically formed toner makes an image transfer true to a latent image along the line of electric force, because the toner particles also have a low adherence each other and therefore the toner is susceptible to the line of electric force. However, when a recording medium is released from a photoconductor, a high-electric field is induced between the photoconductor and the recording medium, which is called burst phenomenon, and this causes a problem that toner transferred onto the recording medium and the photoconductor is scattered, and toner dust occurs on the recording medium. Toner dust is conspicuously found in a full-color image forming apparatus in which toners colored in various tints are superimposed. This causes serious problems particularly in a full-color image forming apparatus that high-quality of image is required.

Further, a toner formed in a shape close to a perfect sphere has a problem that it is hard to be cleaned by a conventionally used blade cleaning. This is because a spherically formed toner is liable to roll on a surface of a photoconductor and the toner slips through a clearance between the photoconductor and a cleaning blade.

Summarizing the above, it is a new challenge to control surface conditions of a toner so as to properly give adherence between a toner and a photoconductor or adherence among toner particles while providing a toner design in consideration of smaller sizing of toner particle diameter and producing a spherically formed toner. There have been various proposals presented so far for controlling shapes of toners in smaller size and in a spherical shape particularly with a view to improving cleanability. For example, there is a proposal which attempts to improve cleanability by defining one shape factor of SF-1 or SF-2 or both shape factors to control a toner shape. The shape factor SF-1 is an indicator representing the level of circularity or sphericity of a toner particle, and the shape factor SF-2 is an indicator representing the level of concave-convex formation of a toner particle to represent a toner shape. For example, see Patent Literature 1 to 8.

However, when cleanability is improved by defining a toner surface shape, excellent transferring properties and the quality of image are traded off against the cleanability, and it is difficult to produce a toner satisfying these requirements.

Among the above-noted patent application disclosures, Patent Literature 7 discloses a cleaning apparatus in which a cleaning blade and a cleaning brush are arranged to make contact with each other, the proximity distance between the contact edge of the cleaning blade contacting a transferring belt and the cleaning brush radius relative to the contact edge is 0.5 mm to 3 mm, and the reversely rotated angle is configured to be wider than the distance between the contact edge of the cleaning blade and a contact point between the transferring belt and the cleaning brush. Patent Literature 7 also proposed to use a toner having the average circularity of 0.90 to 0.99, a shape factor SF-1 of 120 to 180, a shape factor SF-2 of 120 to 190, and a Dv/Dn ratio, i.e. a ratio of the volume average particle diameter to the number average diameter, of 1.05 to 1.30 in the cleaning apparatus. The toner formed with the above configurations has a surface shape which is advantageous to blade-cleaning because of its concave-convex formed on the surface.

However, when a toner is formed in a concavo-convex shape like the toner stated above, it is likely to cause a problem that the initial charge build-up time may be delayed or the charged amount of individual toner particles may be reduced, because the frequency that the concave portions of the toner make contact with carriers is reduced.

To respond to the above problem, for example, Patent Literature 8 discloses a toner production method in which a wet-charge-controlling agent is externally added to a surface of the toner. The toner disclosed in Patent Literature 8, however, has a problem that the charged amount of individual toner particles are unstable with the lapse of time, and the charged amount conspicuously decreases due to stress particularly in an image developing apparatus, although the initial charge build-up time is improved to be quickened up.

In recent years a cleaning-less method in which transferring efficiency is increased by a spherically formed toner has become increasingly popular.

For example, Patent Literature 9 discloses a cleaning-less image forming apparatus using a spherically formed toner which comprises a charge-controlling agent and/or organic fine particles to increase transferring efficiency and to reduce the amount of transferred residual toner. In the image forming apparatus, among the transferred residual toner only backwardly charged toner is collected with a brush-roller and discharged to a photoconductor drum at a given timing and transferred to an intermediate transferring belt, and when the backwardly charged toner passes through the charged area, charge failures of a latent image carrier due to the transferred residual toner adhered to a charge member can be prevented by stopping a charge bias or by moving a charge roller away from the photoconductor drum.

However, the smaller the toner particle diameter is, transferring properties degrade. This is caused by the fact that non-electrostatic adherence such as van der Waals force or the like which works on between a toner and a photoconductor increases in proportion to its empty weight, and therefore, releasing properties degrade.

The image forming apparatus described in Patent Literature 9 utilizes a characteristic that a spherically formed toner has high-transferring properties and is configured to collect toner without using a cleaning member, however, when the toner is formed to have smaller particle diameter, it is difficult to remove the toner by means of the cleaning-less method in an assured way.

Thus, it is necessary to obtain a toner which is suitable for toner cleaning using a cleaning member and is formed in a spherical shape.

However, in cleaning a toner formed in a spherical shape and having smaller particle diameter from above an image carrier, the following problems are caused.

As a toner-removing unit for removing residual toner remaining on an image carrier after transferring of an image, a blade-cleaning method has been used because of its simple configurations and excellent removing ability. A cleaning blade removes residual toner while scraping a surface of an image carrier, however, a microscopic space is developed between the image carrier and the cleaning blade, because an edge of the cleaning blade is transformed by the action of frictional resistance worked against the image carrier. A toner formed in smaller size in diameter easily moves into the clearance. The closer to a sphere the toner moved into the clearance formed, the lesser the rolling frictional force the toner has. Therefore, the toner begins rolling in the clearance between the image carrier and the cleaning blade and slips through the cleaning blade, which leads to a cleaning failure.

As a means to resolve the problems, for example, Patent Literature 10 discloses a toner for developing an electrostatic image which improves blade-cleanability. In the toner-production method the toner can be obtained by polymerizing a polymerizable monomer containing low-melting-point materials and colorants in a medium, and specifically, the toner comprises 5 parts by mass to 30 parts by mass of the material having a low-melting point relative to 100 parts by mass of the polymerizable monomer, and among dynamic viscoelasticity parameters obtained by a sinusoidal oscillation technique, the storage elastic modulus G' of the toner is in the range of $8.00\times10^3$ dyne/cm$^2$<G'≦$1.00\times10^9$ dyne/cm$^2$. The toner particles formed in a shape substantially a perfect sphere are deformed by externally giving forces to thereby yield the cleanability-improved toner.

However, the invention disclosed in Patent Literature 10 cannot keep up transferring properties of toner, because the invention does not employ a deforming process in which the toner is maintained in a spherical shape.

Patent Literature 1 Japanese Patent Laid-Open Application (JP-A) No. 2000-122347

Patent Literature 2 JP-A No. 2000-267331

Patent Literature 3 JP-A No. 2001-312191

Patent Literature 4 JP-A No. 2002-23408

Patent Literature 5 JP-A No. 2002-311775

Patent Literature 6 JP-A No. 09-179411

Patent Literature 7 JP-A No. 2004-053916

Patent Literature 8 International Publication No. WO04/086149

Patent Literature 9 JP-A No. 2004-177555

Patent Literature 10 JP-A No. 08-044111

DISCLOSURE OF INVENTION

It is therefore an object of the present invention to provide a toner enabling excellent transferring properties and cleanability, fixability as well as forming a high-precision image without substantially degraded image quality even after the image is printed on a number of sheets of paper. The present invention further provides a production method of the toner, an image forming apparatus, an image forming method, and a process cartridge.

As a result of keen examinations to resolve the above-noted problems, the inventors of the present invention found that a toner appropriately making contact with individual members by controlling its surface so as to have appropriate adherence with the individual members enables forming a high-quality image and keeping up favorable cleanability.

A toner according to the present invention comprises toner-base particles with a binder resin and a filler included therein and inorganic fine particles, and the filler is contained in a filler-layer in the vicinity of a surface of the toner-base particle, the number average diameter of the primary particle of the inorganic fine particles of 90 nm to 300 nm, and the average circularity of the toner is 0.95.

Preferably, an aspect of the present invention is a toner in which the filler-existence ratio $X_{surf}$ in a region in the vicinity of a surface of the toner-base particle and the average-filler-existence ratio $X_{total}$ of the entire toner-base particles satisfy the following relation: $X_{surf}>X_{total}$.

Preferably, an aspect of the present invention is a toner in which the filler-existence ratio $X_{surf}$ in a region in the vicinity of a surface of the toner-base particle represents a filler-existence ratio in a region of 200 nm from the surface of the toner-base particle; and an aspect of the toner in which the part of the filler exists in a state being exposed on a surface of the toner, an aspect of the toner in which the content of the filler in the toner is 0.01% by mass to 20% by mass.

Preferably, an aspect of the present invention is a toner in which the ratio of the number average particle diameter of the primary particles of the filler to the volume average particle diameter of the toner is 0.1 or less; and an aspect of the toner in which the number average particle diameter of the primary particles of the filler is 0.001 μm to 0.5 μm.

Preferably, an aspect of the present invention is a toner in which the filler is an inorganic filler or an organic filler; an aspect of the toner in which the inorganic filler comprises one selected from the group consisting of metallic oxides, metallic hydroxides, metallic carboxylates, metallic sulfate, metallic silicates, metallic nitrides, metallic phosphates, metallic berates, metallic titanates, metallic sulfides, and carbons; and an aspect of the toner in which the organic filler comprises one selected from the group consisting of urethane resins, epoxy resins, vinyl resins, ester resins, melamine resins, benzoguanamine resins, fluorine resins, silicone resins, azoic pigments, phthalocyanine pigments, condensed-polycyclic pigments, dyeing lake pigments and organic waxes.

Preferably an aspect of the present invention is a toner in which the filler comprises silica, alumina, or titania; an aspect of the toner in which the filler comprises silica, and the silicon content of the surface of silica according to the X-ray photoemission spectroscopy is 0.5 atomic % to 10 atomic %; an aspect of the toner in which the filler comprises an organosol synthesized by a wet process; and an aspect of the toner in which the surface of the filler is subjected to a surface treatment with at least one selected from the group consisting of silane coupling agents, titanate coupling agents, alminate coupling agents, and tertiary amine compounds.

Preferably, an aspect of the present invention is a toner in which the filler has a hydrophobicization degree of 15% to 55%; an aspect of the toner in which the inorganic fine particles comprise silica in a spherical shape; an aspect of the toner in which the inorganic fine particles are produced by a sol-gel process; and an aspect of the toner in which the toner is obtained by dispersing the toner in an aqueous medium in which the dispersed toner is subjected to a surface treatment with a fluorine-containing quaternary ammonium salt.

Preferably, an aspect of the present invention is a toner in which the toner has a fluorine atom content of the fluorine-containing compound being from 2.0 atomic % to 15 atomic % according to X-ray photoemission spectroscopy; an aspect of the toner in which a charge-controlling agent is externally added to the toner-base particles; an aspect of the toner in which the charge-controlling agent is externally added to the toner-base particles by a wet process; and an aspect of the toner in which the toner further comprises a wax.

Preferably, an aspect of the present invention is a toner in which the binder resin comprises a modified polyester (i); an aspect of the toner in which the toner comprises an unmodified polyester (ii) as well as the modified polyester (i) and has a mass ratio of the modified polyester to the unmodified polyester is 5/95 to 80/20; and an aspect of the toner in which the toner-base particles are produced by dispersing and dissolving toner materials comprising a polyester prepolymer having a functional group containing a nitrogen atom, a polyester, and a filler in an organic solvent and further dispersing the toner materials in an aqueous mediums and subjecting at least the polyester prepolyer to a cross-linking and/or an elongation reaction.

Preferably, an aspect of the present invention is a toner in which the toner has a shape factor SF-1 of 110 to 140, a shape factor SF-2 of 120 to 160, a ratio Dv/Dn of a volume average particle diameter (Dv) to a number average particle diameter (Dn) being 1.01 to 1.40; and an aspect of the toner in which the toner is a full-color image forming toner used for an image forming apparatus, in which color-images formed on a latent image carrier are sequentially transferred onto an intermediate transferring member and then transferred onto a recording medium in block to fix the color images and thereby form a full-color image.

The developer used in the present invention is a developer for developing a latent electrostatic image formed on a latent image carrier, and the developer is a two-component developer which comprises the toner of the present invention and carriers.

A process cartridge according to the present invention comprises a latent image carrier which carries a latent image and an image developing apparatus configured to develop the latent electrostatic image formed on the surface of the latent image carrier into a visible image by supplying a toner to the latent electrostatic image, in which the latent image carrier and the image developing apparatus are formed in a single body and detachably mounted to the main body of an image forming apparatus, and the toner is the toner of the present invention.

An image forming apparatus according to the present invention comprises a latent image carrier which carries a latent image, a charging unit configured to uniformly charge a surface of the latent image carrier, an exposing unit configured to expose the charged surface of the latent image carrier based on image data to form a latent electrostatic image on the latent image carrier, an image developing apparatus configured to develop the latent electrostatic image formed on the surface of the latent image carrier into a visible image by supplying a toner to the latent electrostatic image, a transferring unit configured to transfer the visible image on the surface of the latent image carrier to a recording medium, and a fixing unit configured to fix the visible image on the recording medium, and the toner is the toner of the present invention.

An image forming method according to the present invention comprises charging a surface of a latent image carrier uniformly, exposing the charged surface of the latent image carrier based on image data to form a latent electrostatic image on the latent image carrier, developing the latent electrostatic image formed on the surface of the latent image carrier into a visible image by supplying a toner to the latent electrostatic image, transferring the visible image on the surface of the latent image carrier to a recording medium, and fixing the visible image on the recording medium, and the toner is the toner of the present invention.

BEST MODE FOR CARRYING OUT THE INVENTION

Toner

Figure 1:
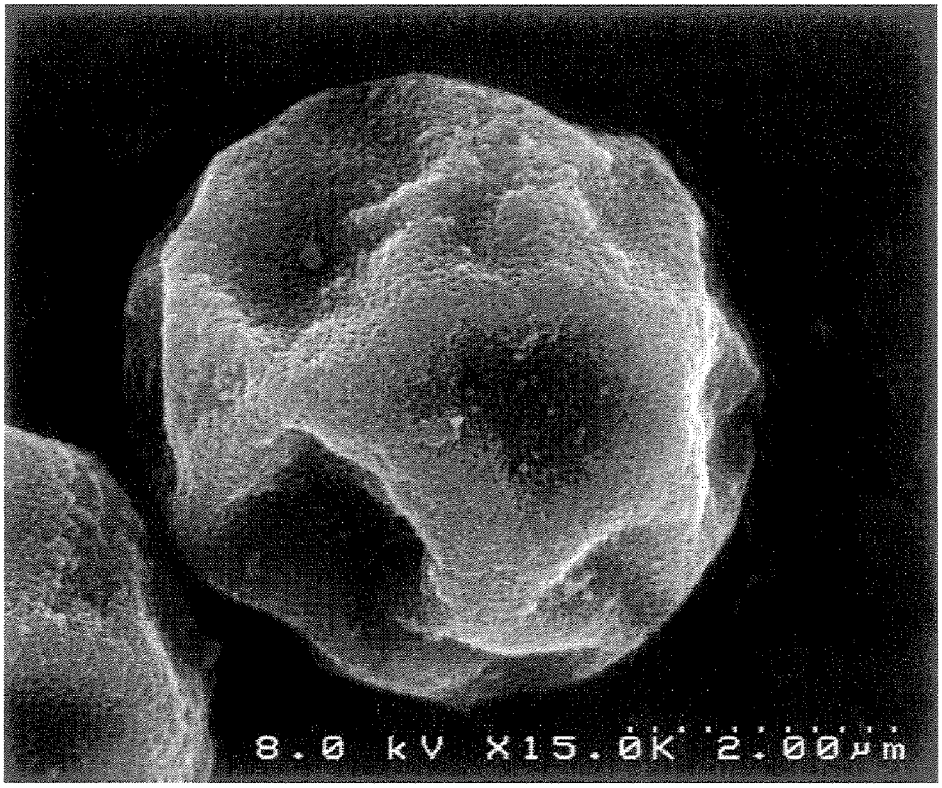
FIG. 1 is an electron photomicrograph exemplarily showing a shape of the toner according to the present invention.

A toner according to the present invention comprises toner-base particles with a binder resin and a filler included therein and inorganic fine particles and further comprises other components in accordance with the necessity.

The filler is contained in a filler-layer in the vicinity of a surface of the toner-base particle, the number average diameter of the primary particle of the inorganic fine particles is 90 nm to 300 nm, and the average circularity of the toner is 0.95.

Here, the specific reason why the toner according to the present invention shows extremely useful effects is unknown which the toner can achieve excellent transferring properties cleanability, and fixability and form a high-precision image without substantially degraded image quality even after the image is printed on a number of sheets of paper. However, by forming a filler-layer in the vicinity of a surface of the toner-base particle, the toner particles have concaves and convexes on their surfaces. It is believed that by containing inorganic fine particles having the number average particle diameter of the primary particle of 90 nm to 300 nm in the toner having such a surface condition and making the toner have the average circularity of 0.95, it enables the state of adherence between the toner and the inorganic fine particles working so that the adherence between the toner and individual members in individual steps of the image forming method is conditioned within an appropriate range, and the toner appropriately having contact with each individual members makes its transferring properties excellent and enables forming a high-quality image while keeping up excellent cleanability.

<Filler-Layer>

The toner according to the present invention comprises a filler-layer in the vicinity of a surface of the toner-base particle. The filler-layer can be observed using a transmission electron microscope (TEM), and it is preferable that a filler be included and involved in the inner portion of the toner-base particles to form a filler-layer along the surface shape of the toner-base particle, not covering over the top surface of the toner-base particle. This is in a state where the filler exists into inner portions from the top surface of the toner-base particle. When the filler is in a state where it is outwardly exposed on a toner-base particle or absorbed to the surface of the toner-base particle to cover over the surface of the toner-base particle, properties of the filler dominate the surface of the toner-base particle and the bulk properties of the toner, and properties of the binder-resin for toner are hard to develop at the surface of the toner. On the contrary, when the filler is included and involved in the inner portions of a toner-base particle, properties of the binder-resin are likely to develop easily. By making the toner have the above-noted configuration, low-temperature image-fixing properties is excellent, and when the toner comprises a wax, the wax is likely to easily exude at the time of heat-fixing, and therefore excellent hot-offset resistivity is obtained.

The filler-layer is preferably formed along the surface shape of the concave-convex of the toner-base particle, however, there is no need to make the filler-layer exist on the entire vicinity portion of the toner surface.

It is believed that the concave-convex shape is formed on a surface of a toner particle by forming a filler-layer in the vicinity of the surface of the toner particle as stated above, because in removing a solvent or the like, the surface-area reducing rate is remarkably lower than the volume-shrinkage rate when the volume of the toner-base particle is shrinking, appropriate elasticity is brought to the surface of the toner-base particle, and the viscosity of inner portions of the toner particle is higher than that of the surface thereof.

As explained in detail in examples hereinafter, the present invention enables making a filler uniformly existing on a toner surface, as described above, by controlling the dispersion intensity when silica is dispersed in an oil-layer.

In a cross-sectional image obtained by using a transmission electron microscope (TEM), when the area ratio of shadows of filler in the region of 200 nm from the toner surface is defined as $X_{surf}$, and the area ratio of shadows of filler in the entire region of the cross-sectional image of the toner is defined as $X_{total}$, the toner according to the present invention satisfies $X_{surf}>X_{total}$.

A toner satisfying the relation has conspicuous concave-convex on the surface thereof and exert excellent cleanability. The filler existing in the vicinity of a surface of the toner serve to keep a stable amount of charge even with the lapse of time and prevent decreases in the amount of charge caused by degradation of toner.

The area ratio $X_{surf}$ of shadows of filler in the region of 200 nm from the toner surface is preferably 50% to 98%, and the area ratio $X_{total}$ of shadows of filler in the entire region of the cross-sectional image of the toner is preferably 1% to 50%.

When the area ratio $X_{surf}$ is 50% or less, a concave-convex shape is not satisfactorily formed on the toner surfaces because a density difference of filler between the vicinity of a toner surface and the entire area portions is inadequate, and charge property degrades because filler cannot be exposed on the surface of the toner particle. On the contrary, when the area ratio $X_{surf}$ is 98% or more, the exposed amount of filler onto the toner surface is increased, which blocks fixability of the toner and degrades low-temperature image-fixing properties.

On the other hand, the area ratio $X_{total}$ is 50% or more, concave-convex formation on the toner surface associated with volume-shrinkage at the time of removing a solvent cannot be observed and low-temperature image-fixing properties also degrade, because a density difference of inorganic fine particles between the vicinity of toner surface and the internal region decrease. When the area ratio $X_{total}$ is 1% or less, concave-convex formation on the toner surface associated with volume-shrinkage does not make progress satisfactorily.

The thickness of a filler-layer formed in the vicinity of a surface of the toner-base particle of the present invention can be determined by analyzing a cross-sectional image of a resin particle through the use of a transmission electron microscope (TEM).

Namely, the toner is dispersed in a sucrose-saturated solution in an amount of 67% by mass and frozen at −100° C. The frozen solution is then sliced into 100 nm in thickness using a cryo-microtome followed by dying of the filler with ruthenium tetroxide and taking a cross-sectional image of a resin particle using a transmission electron microscope at 10,000-fold magnification. In a cross-sectional surface of the particle where the cross-sectional area is the maximum using an image analyzer (for example, nexus NEW CUBE ver. 2.5 (manufactured by NEXUS Inc.)), and in the surface area of the portion of a certain thickness distance taken in a direction inwardly perpendicular to the particle from the surface of the toner particle, the maximum distance in which the area of the filler accounts for 50% or more is defined as the thickness of the filler-layer. It is noted that the determined value is the average value which is calculated from respective values for 10 pieces of toner particles selected randomly.

In observing an image taken by a transmission electron microscope (TEM), when it is difficult to distinguish a filler-layer and resinic portions, mapping of a cross-sectional image of a resin particle obtained according to the above-noted method is carried out by using various apparatuses capable of mapping of compositions of resin particles, (for example, an energy-dispersive-X-ray spectrometer (EDX), an electron-energy-loss spectrometer (EELS)) to identify a filler-layer from the image of the composition-distribution obtained from the analysis and then to calculate the thickness of the filler-layer according to the method stated above.

FIG. 1 shows an example of a shape of the toner according to the present invention.

The filler is preferably included and involved in the toner, and a certain amount of the filler is preferably exposed on a surface of the toner-base particle. The filler exposed on the surface of the toner-based particle enables improving fluidity of a toner and obtaining high-charge property.

When a material having a hydroxy group such as silica is used as a filler and a cationic surfactant is used as a charge-controlling agent, the hydroxy group on a surface of a fine particle exposed on the toner surface is ion-bound to or absorbed to the charge-controlling agent. The mutual interaction enables obtaining higher-charge-build-up properties and higher amounts of charge.

Therefore, the amount of external additives to be added as charging-agents afterward can be restrained to a small amount, and released external additives can be restrained. Further, it is possible to prevent filming of the released external additives onto a photoconductor and surfaces of carriers.

The thickness of the filler-layer is preferably 0.005 μm to 0.5 μm, more preferably 0.01 μm to 0.2 μm, and still more preferably 0.02 μm to 0.1 μm.

Such a filler-layer can be suitably formed by dispersing a dispersion liquid of toner materials in which at least a binder resin and a filler are dispersed and/or dissolved in an organic solvent is dispersed in an aqueous medium and subjecting the obtained droplets to processes such as removing, drying, or the like of the medium and water, which is referred to as solvents herein, to be made into solid particles and to thereby produce toner-base particles.

It is believed that a concave-convex shape on the surface of toner-base particles is formed at the time of volume-shrinkage of toner-base particles in the process of removing the solvents, because surface-area reducing rate is remarkably lower than the volume-shrinkage rate, appropriate elasticity is brought to the surface of toner-base particle, and the viscosity of inner portions of the toner particle is higher than that of the surface thereof.

When the thickness of the outer-layer of filler is in the range stated above, the difference in viscosity between a surface of toner-base particle and the inner portion of the particle increases to make concaves-convexes easily exposed on the surface of the particle.

The method for dispersing the filler is not particularly limited, and those known in the art may be used, for example, the following dispersion methods can be used.

(1) A method of which a binder resin and a filler are fused and kneaded, in accordance with the necessity, in the presence of a dispersing agent and/or a dispersing agent to obtain a masterbatch in which the filler dispersed in the binder resin.

(2) A method of which a filler is dissolved or suspended in a dispersing agent with a binder resin in accordance with the necessity and then mechanically wet-ground or milled by a dispersing machine.

(3) A method of which a synthesized filler in a dispersing agent is added and mixed.

(4) A method of which a finishing agent is added to a dispersing agent in which a filler dispersed in water and is subjected to a wet-process, and a solvent-replaced-organosol is added to and mixed with the dispersing agent.

Among these dispersion methods, from the perspective of dispersion stability, it is preferably a method of which a finishing agent is added to a dispersion liquid in which a filler dispersed in water and subjected to a wet-process, and a solvent-replaced-organosol is added to and mixed with the dispersion liquid. To produce a solvent-replaced-organosol, for example, there is a process in which hydrogel of a metallic oxide synthesized by a hydrothermal synthesis method, a sol-gel process, or the like, and a dispersion liquid of organic fine particles obtained by an emulsion-polymerization method, a seed-polymerization method, a suspension-polymerization method or the like are hydrophobized using the finishing agent to replace water by a solvent, preferably, methyl ethyl ketone, ethyl acetate, and the like. For an organosol-production method, for example, a method described in JP-A No. 11-43319 may be suitably used. Examples of the commercially available organosol include Organo Silica Sol MEK-ST, and a MEK-ST-UP (manufactured by NISSAN CHEMICAL INDUSTRIES, LTD.).

Filler

The volume-mean diameter of the primary particle of the filler is preferably 0.001 μm to 0.5 μm more preferably 0.001 μm to 0.1 μm, and still more preferably 0.002 μm to 0.05 μm. When the number average particle diameter of the filler is 0.1 μm or more, the particle diameter is preferably measured by using a laser-measuring apparatus for particle size distribution. When the number average particle diameter of the filler is less than 0.1 μm, it is preferably calculated from the BET specific surface area and the true specific gravity. A BET specific surface area can be determined using an apparatus according to the typical nitrogen-absorption method, and for example, the commercially available apparatus, QUQNTA-SORB (manufactured by QUANTACHROME) can be used. The primary particle diameter of the filler can be determined by dividing the inverse number of the BET specific surface area of the filler by the true specific gravity.

The content of the filler in the toner-base particles is preferably 0.01% by mass to 20% by mass, more preferably 0.1% by mass to 15% by mass, still more preferably 1% by mass to 10% by mass, and particularly preferable 2% by mass to 7% by mass.

The higher the aspect ratio of the filler is, the greater the effect of concave-convex formation on a surface of a toner-base particle is. Thus, the higher the aspect ratio of the filler is, the smaller the amount of addition is required for forming concave-convex on the toner-base particles.

The filler is not particularly limited, provided that it is inorganic or organic granular matter. Fillers may be used alone or in combination of two or more in accordance with the intended use. Colorants, waxes charge-controlling agents or the like which are typically used for a toner can be also used as a filler.

Examples of materials of the organic filler include vinyl resins, urethane resins, epoxy resins, ester resins, polyamide resins, polyimide resins, silicone resins, fluorine resins, phenol resins, melamine resins, benzoguanamine resins, urea resins, aniline resins, ionomer resins, polycarbonate resins, celluloses and mixtures thereof and further include an ester wax (such as carnauba wax, montan wax, and rice wax), polyolefin waxes (such as polyethylene and polypropylene), paraffin waxes, ketone waxes, ether waxes, long-chain (carbon atoms 30 or more) aliphatic alcohols, long-chain (carbon atoms 30 or more) fatty acids, and mixtures thereof. Various organic dyes and organic pigments which are typically used as colorants such as azoic, phthalocyanine, condensed-polycyclic compounds, and color lakes, and derivatives thereof can be used as organic fillers, of which various organic dyes and organic pigments such as azoic, phthalocyanine, condensed-polycyclic compounds and color lakes, and derivatives thereof are preferable.

Examples of the inorganic fillers include metallic oxides, such as silica, diatom earth, alumina, zinc oxides, titania, zirconia, calcium oxides, magnesium oxides, iron oxides, copper oxides, tin oxides, chromium oxides, antimony oxides, yttrium oxides, cerium oxides, samarium oxides, lanthanum oxides, tantalum oxides, terbium oxides, europium oxides, neodymium oxides, and ferrite; metal hydroxide such as calcium hydroxide, magnesium hydroxide, aluminum hydroxide, and basic magnesium carbonates; metal carbonates such as heavy calcium carbonates, light calcium carbonates, zinc carbonates, barium carbonates, disunite, hydrosulfite; metal sulfates such as calcium sulfate, barium sulfate, and plaster fibers; metal silicates such as calcium silicate (wollastonite, xonotlite), kaolin, clay, talc, mica, montmorillonite, bentonite, active terra alba, sepiolite, imogorite, sericite, glass fiber, glass beads, glass flake; metal nitrides such as aluminum nitride, borate nitride, and silicon nitride; metal titanates such as potassium titanate, calcium titanate, magnesium titanate, barium titanate, and lead zirconate titanium aluminum borate; metal berates such as zinc borate, and aluminum borate; metal phosphates such as tricalcium phosphate; metal sulfides such as molybdenum sulfide; metal carbides such as silicon carbide; carbons such as carbon black, graphite, and carbon fiber; and other fillers.

Among the above fillers, inorganic fillers are preferably used for the filler, of which metallic oxides are preferable, and silica, alumina, and titania are still more preferable. Among them, silica is particularly preferable and preferred to be used in an organosol configuration. To obtain an organosol of silica, for example, there is a process in which a dispersion liquid of hydrogel of silica synthesized by a wet process such as a hydrothermal synthesis method, and a sol-gel process is hydrophobized using a finishing agent to replace the water by an organic solvent, such as, a methyl ethyl ketone, and an ethyl acetate.

For the filler used for the toner according to the present invention it is preferred to use a filler with the surface thereof finished using a hydrophobizer. For the hydrophobizer, for example, a silane coupling agent, a sililation agent, a silane coupling agent having fluoroalkyl group, an organic titanate coupling agent, and an aluminate coupling agent) or the like can be listed as the preferable finishing agents. Also, satisfactory effects can be obtained with a filler subjected to a surface treatment using silicone oil as a hydrophobizer.

The filler used in the toner of the present invention is preferably subjected to a surface treatment as described above, and the hydrophobization degree according to a methanol-titration method is preferably 15% to 55%.

The hydrophobization degree was determined by the following method. First, 50 ml of ion-exchanged water, 0.2 g of a sample are placed in a beaker, and methanol is dropped while stirring the dispersion liquid. Next, the external additives are made gradually settled out as the density of methanol in the beaker increases, and the mass fraction of methanol in the combined solution of methanol and water at the end of sedimentation of the entire amount of external additives is defined as the hydrophobicization degree (%).

By using inorganic fine particles having a hydrophobicization degree which is within the range stated above, deformation of toner can make progress favorably, and it is possible to form a suitable concave-convex shape on a surface of a toner.

Si-Concentration on Toner Surface

For an inorganic filler to be internally added to the toner particles, silica is particularly preferable.

When silica is used as an inorganic filler to be internally added to the toner particles, the concentration of silicon existing on a surface of the toner particle which is caused by silica exposed on the toner surface is preferably 0.5 atomic % to 10 atomic %.

When the concentration is less than 0.5 atomic %, charge property is unstable, because satisfactory fluidity and charge effect cannot be obtained. When the concentration is more than 10 atomic %, properties of the inorganic filler dominate the surface and the bulk properties of the toner, and properties of the binder-resin for toner are hard to develop at the surface of the toner.

The amount of silica existing on a surface of the toner-base particle is measured by using the XPS, i.e. X-ray photoelectron spectroscopy. Here, a nanometer-scale region of a toner surface being approx. several nanometers is measured.

The measurement was performed by using a 1600S Model X-ray photoelectron spectrometer manufactured by PHI Co., Ltd. The X-ray source was MgKα (400 W), and analyzed area was 0.8 mm×2.0 mm. As the pretreatment of the measurement, the sample was stuffed into an aluminum dish, and the dish was bound with a carbon sheet to the sample holder. The atomic percent on the surface was calculated using a relative sensitivity factor provided by PHI Co., Ltd.

The measurement method, the type of measuring apparatus, and the measurement conditions are not particularly limited, provided that similar results can be obtained, however, the following conditions are preferable.

Inorganic Fine Particles

As inorganic fine particles having a number average diameter of the primary particle being 90 nm to 300 nm, it is possible to use metallic oxide fine particles such as silica, alumina, titania, zirconium oxide, iron oxide, magnesium oxide, calcium oxide, manganese oxide, zinc oxide, strontium oxide, strontium titanate, barium oxide, and cesium oxide.

Among these inorganic fine particles, silica is preferable because it is white in color, can be used for color toners, and is highly safe. For the production method of silica, two production methods have been established, indefinitely shaped toner particles and spherically shaped toner particles can be produced.

There are the methods for producing silica, in the case of indefinitely shaped fine particles, a method of producing combustion-type silica which combusts silicon tetrachloride in a gas phase, and in the case of spherically shaped fine particles, a method according to the sol-gel process in which a silicon oxide is deposited in an aqueous phase. In the sol-gel process, alkoxysilane is hydrolyzed, decomposed, and condensed in an aqueous solution to make silica deposited. Examples of the alkoxysilane include tetramethoxysilane, tetraethoxysilane, tetraisoproxysilane, and tetrabutoxysilane. Examples of the catalyst for hydrolysis include ammonia, urea, and monoamine.

From the perspective of improving transferring-rate, preventing occurrence of dust at the time of transferring, and keeping up excellent cleanability, silica fine particles having a number average diameter of the primary particle being 90 nm to 300 nm is preferably formed in a spherical shape and produced according to the sol-gel process.

Further, it is effective to perform a surface reformation treatment of silica fine particles using a hydrophobizer or the like. As the hydrophobizer, it is possible to use dimethyldichlorsilane or DDS, trimethylchlorsilane, methyltrichlorsilane, allyldimethyldichlorsilane, allylphenyldichlorsilane, benzildimethylchlorsilane, brommethyldimethylchlorsilane, α-chlorethyltrichlorsilane, ρ-chlorethyltrichlorsilane, chlormethyldimethylchlorsilane, chlormethyltrichlorsilane, hexamethyldisilazine or HMDS, hexaphenyldisilazine, hexatolyldisilazine, and the like.

When the number average particle diameter of the inorganic fine particles is less than 90 nm, inorganic fine particles are buried into the toner due to use of toner over time, the toner undergoes impact force because carriers or toner particles are stirred and mixed in an image developing apparatus. When the average particle diameter of the inorganic fine particles is more than 300 nm, the inorganic fine particles are liable to move away from the toner surface to cause change in the toner properties, which leads to an abnormal image such as ground fogging of toner or decreases in toner density. The average particle diameter of the inorganic fine particles is more preferably 100 nm to 150 nm.

It is preferred to make 0.3% by mass or more inorganic fine particles contained relative to the toner. Since the particle diameter of the inorganic fine particles the number of pieces per unit mass is small. Thus, when the content of inorganic fine particles is less than 0.3% by mass, the number of pieces of inorganic fine particles on the toner surface is so small that contributions of effect to transferring property and cleanability are poor. However, the content of inorganic fine particles is preferable not to be more than 5% by mass. When it is more than 5% by mass, inorganic fine particles are liable to move away from the toner surface, which may cause an abnormal image, and it tends to cause problems with toner scattering, smear in a copier, photoconductor-flaws and abrasion.

In addition, besides the above-noted inorganic fine particles, inorganic fine particles and organic fine particles may be further added to the toner as external additives. By using other inorganic fine particles and organic fine particles as external additives, fluidity and charge property of the toner can be controlled.

Specifically examples of the other inorganic particles include silica, alumina, titanium oxides, barium titanate, magnesium titanate, calcium titanate, strontium titanate, zinc oxides, tin oxides, silica sand, clay, mica, wallastonite, silious earth, chromium oxides, ceric oxides, colcothar, antimony trioxides, magnesium oxides, zirconium oxides, barium sulfates, barium carbonates, calcium carbonates, silicon carbides, and silicon nitrides. For the organic fine particles, it is possible to use, for example, polymer fine particles such as polymer particles made from polystyrene copolymers, methacrylic acid ester copolymers, and acrylic acid ester copolymers obtained by a soap-free emulsion polymerization, a suspension polymerization, and a dispersion polymerization; and condensation polymers such as silicone, benzoguanamine, and nylon, and polymer particles using thermosetting resins. The external additives stated above enable preventing degradations of fluidity and charge property of toners even under high-humidity environments by performing a surface treatment thereof and improving hydrophobic properties. Examples of the preferable finishing agents include silane coupling agents, sililation agents, silane coupling agents having a fluorinated alkyl group, organic titanate coupling agents, aluminum coupling agents, silicone oils, and modified silicone oils.

Particularly, from the perspective of improving fluidity of toner and stabilizing charge property, it is preferable to use hydrophobic silicas and hydrophobic titanium oxides obtained by subjecting silica and/or titanium oxide to the surface treatment, and it is useful in conjunction with a hydrophobic silica and a hydrophobic titanium oxide at the same time. The particle diameter of the primary particle of these other inorganic fine particles and organic fine particles is preferably 8 nm to 50 nm, and more preferably 8 nm to 40 nm. The proportion of these other inorganic or organic fine particles for use to the toner is preferably 0.01% by mass to 5% by mass, and more preferably 0.1% by mass to 2.0% by mass.

As a typical method for making the inorganic fine particles having a particle diameter of 90 nm to 300 nm and other inorganic particles and organic particles contained in the dispersion liquid of toner materials, these inorganic fine particles or the like and the toner-base particles are placed in a mixer and stirred. Besides, these inorganic and organic particles can be externally added to the toner materials, in an aqueous solution and/or an alcohol solution, for example, inorganic fine particles or the like are placed to an aqueous solution in which toner is dispersed, so as to adhere to the toner surface. When the inorganic fine particles or the like are hydrophobized, these inorganic fine particles may be dispersed after using in conjunction with a small amount of alcohol to reduce interfacial force so as to easily get wet. Afterward, the inorganic fine particles can be heated to remove the solvent and can then be fixed to prevent them from moving away from the toner surface. The processes enable making the inorganic fine particles dispersed on the toner surface uniformly.

In addition, by adding a surfactant when a toner and additives are dispersed in an aqueous solution, it is possible to make the additives further dispersed on the toner surface uniformly. In this case, a surfactant which is antipolar to the inorganic fine particles or toner is preferably used.

Addition of Charge-Controller According to Wet-Process

When the toner surface is formed in a concave-convex shape, as describe above, the contact surface area between the toner and carriers is reduced because concave portions cannot make contact with the carriers. Accordingly, charging abilities of the toner itself, in particular, the initial-charge build-up rate degrades.

In the toner according to the present invention, a charge-controlling agent is further externally added to a surface of the toner-base particle in which a filler exists in the vicinity of the toner surface at high-density to compensate for decreases in charging abilities as described above. This enables making a toner which excels in initial-charge-build-up property without any decreases in the amount of charge even with the lapse of time and having excellent cleanability while keeping up highly stable charge performance.

It is preferred to externally add a charge-controlling agent according to a wet-process external addition. The wet-process external addition is performed by making dispersing elements of fine particles of a charge-controlling agent exist in a slurry in which toner-base particles are re-dispersed in an aqueous solution.

By externally adding agents according to a wet-process, a charge-controlling agent can be uniformly given to a surface of the toner according to the present invention, and shortage of the amount of charge in the toner associated with decreases in frequency of contact between the concave-portions on the toner surface and carriers.

As the charge-controlling agent, an anionic or cationic surfactant can be used. The charge-controlling agent can be used in an amount 0.05% by mass to 1% by mass relative to the mass of the toner, and preferably can be used in an amount 0.1% by mass to 0.3% by mass.

Examples of the anionic surfactants include alkyl benzene sulphonates, α-olefin sulphonates, and phosphoric esters.

Examples of the cationic surfactants include alkylamine salts, amino alcohol fatty acid derivatives, polyamine fatty acid derivatives, amino salts cationic surfactants such as imidazoline; quaternary ammonium salts cationic surfactants such as alkyltrimethylammonium salts, dialkyldimethylammonium salts, alkyldimethylbenzylammonium salts, pyridinium salts, alkylisoquinolinum salts, and benzethonium chloride.

In addition, nonionic surfactants such as fatty acid amide derivatives, and polyhydric alcohol derivatives; and amphoteric surfactants such as alanine, dedecyldi(aminoethyl)glycine, di(octylaminoethyl) glycine, N-alkyl-N,N-dimethylammonium betaine may be used.

The amount of use of these surfactants is preferably 0.1% by mass to 10% by mass to the entire amount of aqueous phase.

Fluoride Surfactant

In the present invention, by using a fluoride surfactant, it is possible to obtain favorable effect to charge-performance, in particular, to charge-build-up property.

Preferred examples of anionic surfactants having a fluoroalkyl group are fluoroalkyl carboxylic acids each containing 2 to 10 carbon atoms, and metallic salts thereof, disodium perfluorooctanesulfonyl glutaminate, sodium 3-[ω-fluoroalkyl (carbon atoms 6 to 11) oxy]-1-alkyl (carbon atoms 3 to 4) sulfonate, sodium 3-[ωfluoroalkanoyl (carbon atoms 6 to 8)-N-ethylamino]-1-propanesulfonate, fluoroalkyl (carbon atoms 11 to 20) carboxylic acids and metallic salts thereof, perfluoroalkyl carboxylic acids (carbon atoms 7 to 13), and metallic salts thereof, perfluoroalkyl (carbon atoms 4 to 12) sulfonic acids and metallic salts thereof, perfluorooctanesulfonic acid diethanolamide, N-propyl-N-(2-hydroxyethyl) perfluorooctanesulfonamide, perfluoroalkyl (carbon atoms 6 to 10) sulfonamide propyl trimethyl ammonium salts, perfluoroalkyl (carbon atoms 6 to 10)-N-ethylsulfonyl glycine salts, and monoperfluoroalkyl (carbon atoms 6 to 16) ethyl phosphoric esters.

Such fluoroalkyl-containing anionic surfactants are commercially available under the trade names of, for example, Surflon S-111, S-112, and S-113 (manufactured by ASAHI GLASS CO., LTD.); Fluorad FC-93, FC-95, FC-98, and FC-129 (manufactured by Sumitomo 3M Ltd.); Unidyne DS-101, and DS-102 (manufactured by DAIKIN INDUSTRIES, LTD.); Megafac F-110, F-120, F-113, F-191, F-812, and F-833 (manufactured by Dainippon Ink & Chemicals, Inc.); EFTOP EF-102, 103, 104, 105, 112, 123A, 123B, 306A, 501, 201, and 204 (manufactured by JEMCO Inc.); and FTERGENT F-100 and F150 (manufactured by NEOS Co., Ltd).

Examples of fluoroalkyl-containing cationic surfactants for use in the present invention include aliphatic primary, secondary and tertiary amic acids each having a fluoroalkyl group; aliphatic quaternary ammonium salts such as perfluoroalkyl (carbon atoms 6 to 10) sulfonamide propyltrimethyl ammonium salts; benzalkonium salts, benzethonium chloride, pyridinium salts, and imidazolium salts. Such fluoroalkyl-containing cationic surfactants are commercially available, for example, under the trade names of Surflon S-121 (manufactured by ASAHI GLASS CO., LTD.); FLUORAD FC-135 (manufactured by Sumitomo 3M Ltd.); Unidyne DS-202 (manufactured by DAIKIN INDUSTRIES, LTD.); Megafac F-150, and F-824 (manufactured by Dainippon Ink & Chemicals, Inc.); EFTOP EF-132 (manufactured by JEMCO Inc.); and FTERGENT F-300 (manufactured by NEOS Co., Ltd).

In the present invention, it is particularly preferred to use a cationic surfactant.

When inorganic fine particles having a hydroxyl group such as silica is used as inorganic fine particles to be internally added to the toner particles, the hydroxyl group on the surface of fine particles which are exposed on the toner surface and the charge-controlling agent are ion-bound to or physically absorbed to each other, and these interactions enable obtaining higher charge-build-up property and a higher amount of charge.

In addition, by using a fluoride-containing quaternary ammonium salt represented by the chemical formula (1), it is possible to obtain a stable developer which has a small change in the amount of charge when an environment varies.

Chemical Formula (1)

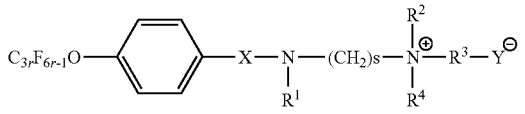

In the chemical formula (1), X represents —$SO_2$— or —CO—. $R^1$, $R^2$, $R^3$, and $R^4$ respectively represent hydrogen atom, lower-alkyl group or aryl group having carbon atoms 1 to 10. Y represents I or Br, and r and s respectively represent an integer from 1 to 20.

Fluoride-Density on Toner Surface

When a fluoride-containing compound is used as a charge-controlling agent, the density of fluoride on the toner surface can be detected according to the XPS method. The toner surface is preferably subjected to a surface treatment so that the content of fluoride atom derived from the fluoride-containing compound is 2.0 atomic % to 15 atomic %.

When the detected amount of the fluoride atom on the toner surface according to the XPS method is less than 2.0 atomic %, not only decreases in the initial-charge property but also in charge property with the lapse of time are likely to occur, which develops problems with background smear or numerous number of black points on an image and toner scattering, or the like, because satisfactory charge effects cannot be obtained. When the detected amount of the fluoride atom is more than 15 atomic %, it is not preferable, because image-density troubles caused by high-amount of charge and further fixing troubles of a developer will occur.

The measurement according to the XPS method can be performed in the same manner as that of the amount of inorganic fine particles existing on the toner surface which are internally added in the toner particles.

Silica used in the present invention is preferably used in an organosol configuration. To obtain an organosol of silica, for example, there is a process in which a dispersion liquid of silica hydrogel synthesized by a wet process such as a hydrothermal synthesis method, and a sol-gel process, is hydrophobized using a surface treatment agent to replace the water by an organic solvent, such as, a methyl ethyl ketone, and an ethyl acetate.

For the specific production method of the organosol, for example, a method described in JP-A No. 09-179411 can be suitably used.

By adding an organosol obtained according to the above method of an oil phase of the toner and mixing them, it is possible to make silica dispersed in the oil phase of the toner in a state of high-dispersion stability.

Average Circularity of Toner

The average circularity of the toner is measured using a flow-particle-image analyzer (FPIA-2000; manufactured by Sysmex Corp.). To a given vessel, 100 ml to 150 ml of water with impure solid matters preliminarily removed is placed, 0.1 ml to 0.5 ml of a surfactant is added as a dispersing agent, and about 0.1 g to 9.5 g of a sample of a toner is further added.

The suspension liquid in which the sample is dispersed was subjected to a dispersion process for about 1 minute to 3 minutes using an ultrasonic dispersing apparatus, and the concentration of the dispersion liquid is set to 3,000 number of pcs./μL to 10,000 number of pcs./μL and then to measure the shape and distribution of the toner.

The toner of the present invention has an average circularity of 0.95, the shape of the projected toner is close to a circle, the average circularity is preferably 0.94 to 0.98. As a result, the toner excels in dot reproductivity and enables obtaining a high transferring rate. When the average circularity is less than 0.94, the toner has a non-spherical shape, dot reproductivity of the toner degrades, and since the number of contact points between a latent image carrier and a photoconductor increase, adherence with the photoconductor increases, resulting in lower transferring rates.

Dv/Dn

The toner of the present invention preferably has a volume mean diameter (Dv) of 3.0 μm to 8.0 μm and a ratio (Dv/Dn) of a volume mean diameter (Dv) to a number average diameter (Dn) is preferably 1.01 to 1.40, and more preferably 1.01 to 1.30. By forming a toner having such a particle diameter and particle diameter distribution, it is possible that the toner excels in any of heat-resistant-storage properties, low-temperature image-fixing properties and hot-offset resistivity, and particularly when used in a full-color copier, excellent gloss properties can be obtained in an image.

Generally, it is said that the smaller a toner particle is, the more advantageous in obtaining a high-resolution and high-quality image, however at the same time, it is disadvantageous in terms of a transferring rate and cleanability. When a volume mean diameter is smaller than the minimum diameter of the present invention and when used as a two-component developer the toner fuses on the surface of magnetic carriers in a long hours of stirring in an image developing apparatus, and it makes charging abilities of the magnetic carriers lowered, and when used as a one-component developer, toner-filming to a developing roller and toner fusion onto a member, such as, a blade, for making a toner have a thin layer, are liable to occur.

On the other, when a toner volume mean diameter is greater than the maximum diameter of the present invention, it is harder to obtain a high-resolution and high-quality image, and it is often the case that toner particle diameter largely varies when toner inflow/outflow being performed in a developer.

When Dv/Dn is more than 1.40, it is not preferable because distribution of an amount of charge is broader, resulting in degraded resolutions.

The average particle diameter and the particle size distribution of a toner can be measured using Coulter Counter TA-II, and Coulter Multisizer (both manufactured by Beckman Coulter, Inc.). The measurement was performed as follows. To 100 ml to 150 ml of an electrolytic solution, 0.1 ml to 5 ml of a surfactant, preferably alkylbenzene sulphonate, was added as a disperser. Here, the electrolytic solution is the one that approx. 1% of NaCl aqueous solution is prepared with primary sodium chloride using ISOTON R-II (manufactured by Coulter Scientific Japan Co., Ltd.). To the aqueous solution, 2 mg to 20 mg of a sample for measurement was added and suspended in the electrolytic solution, and the electrolytic solution was then subjected to a dispersion process using a supersonic distributor for one minute to three minutes. In the measurement apparatus, an aperture of 100 μm was used, and the volume and the number of pieces of toner particles in the sample were measured on a channel basis to thereby calculate the volume distribution and the number distribution of the toner.

The following 13 channels were used in the measurements. 2.00 μm to 2.52 μm; 2.52 μm to 3.17 μm; 3.17 μm to 4.00 μm; 4.00 μm to 5.04 μm; 5.04 μm to 6.35 μm; 6.35 μm to 8.00 μm; 8.00 μm to 10.08 μm; 10.08 μm to 12.70 μm; 12.70 to 16.00 μm; 16.00 μm to 20.20 μm; 20.20 μm to 25.40 μm; 25.40 μm to 32.00 μm and 32.00 to 40.30 μm.

In addition, the toner of the present invention has moderate concaves and convexes on the surface. As mentioned above, a spherically shaped toner having a low adherence between the toner and a latent image carrier or a low adherence between the toner particles each to each can enables a high transferring rate, however, at the same time such a toner caused problems with occurrences of transferring dust and degradation of cleanability. Accordingly it is preferred that the surface of a toner is not smoothly formed and has concaves and convexes so as to properly contact a latent image carrier. FIG. 1 is an electron photomicrograph showing an example of a shape of the toner of the present invention.

The condition of concaves and convexes formed on the surface of the toner according to the present invention can be represented by a A/S ratio. A condition that the value of the A/S ratio be 15% to 40% is preferable. The condition indicates a condition between point-contact in a value of 15% or less and area-contact in a value of 40% or less which is a condition where a number of continuous point-contact points continue into a quasi-line.

Specifically, the condition implies that in at least one contact surface portion of the contact areas between the toner of the present invention and a glass plane plate, a ratio (L/M) of a long axis L to a minor axis M of the contact surface portion satisfies the relation of (L/M)>3.

Figure 2:
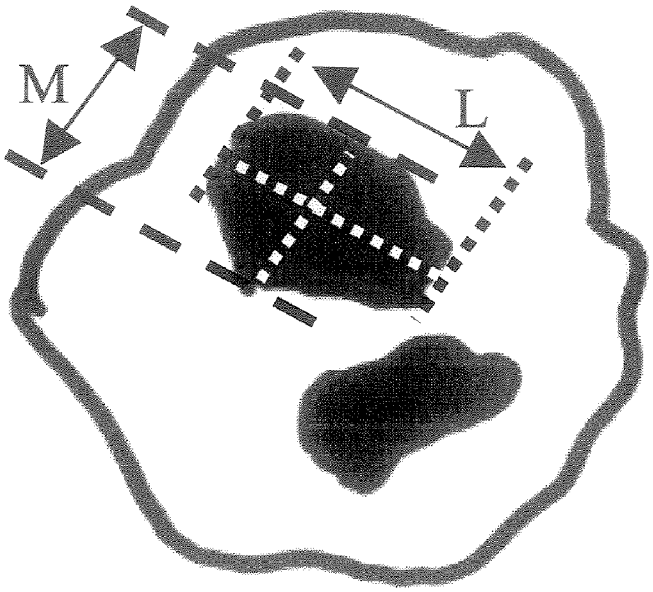
FIG. 2 is a view schematically showing a long axis L and a minor axis M of the contact surface between the toner and a glass plane plate.

FIG. 2 is a view schematically showing a long axis L and a minor axis M of the surface contact area. The value L/M is calculated from a long axis L and a minor axis M of a surface contact portion between the toner and a glass plane plate.

Figure 3A:
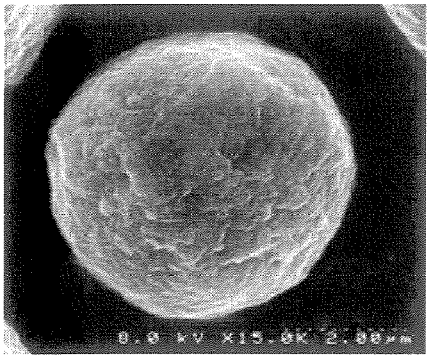
FIG. 3A is a view schematically showing the way a substantially spherical toner particle has contact with a glass plane plate.
Figure 3B:
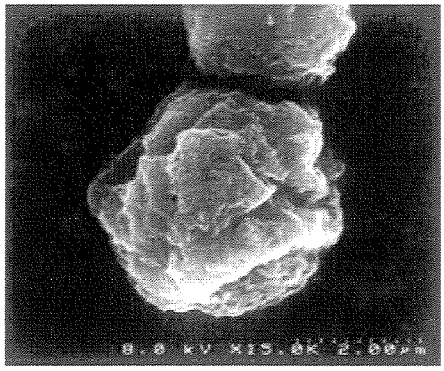
FIG. 3B is a view schematically showing the way a toner particle according to the present invention has contact with a glass plane plate.
Figure 3B:
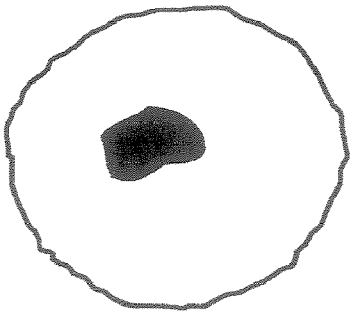
Figure 3B:
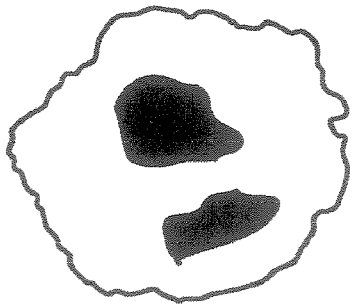
Figure 3C:
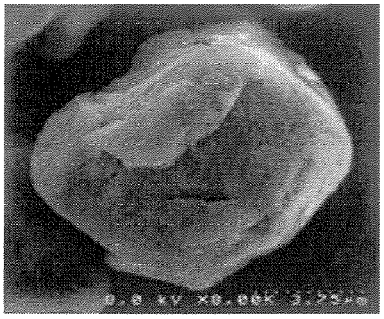
FIG. 3C is a view schematically showing the way a toner particle formed in an indefinite or undetermined shape obtained by a kneading and pulverizing method has contact with a glass plane plate.
Figure 3C:
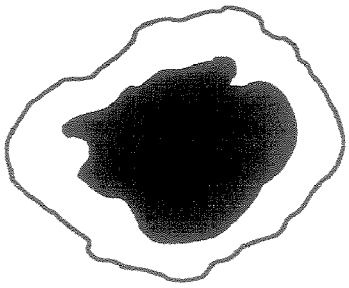

FIGS. 3A, 3B, and 3C are views schematically showing different ways each differently shaped toner particle has contact with a glass plane plate. In the views, contact surface portions of the toner placed on a glass plane plate were blacked out.

FIG. 3A shows a substantially spherical toner particle having a shape with little concaves and convexes formed on the surface. Thus, it is in a state where the contact surface portion of the toner has contact with a glass plane plate in nearly dot-contact condition.

FIG. 3C shows a toner particle formed in an indefinite or undetermined shape obtained by a kneading and grinding method. The toner particle has area-contact with a glass plane plate. When a toner particle is in a condition close to dot-contact with a glass-plane plate, as shown in FIG. 3A, the contact area between the toner and a member contacting the toner is small. For example, when the member contacting the toner is a latent image carrier or an intermediate transferring member, a high transferring rate can be obtained because the toner has excellent releasing properties. However, at the same time, the adherence between the toner and the partner member is small, which may cause transferring dust and degradation of cleanability. When starting a fixing step, a not-fixed toner may roll on a transferring paper, and this may cause an image defect, because the contact between the not-fixed toner on a transferring paper and a fixing member is in an insufficient condition.

When a toner has area-contact with a glass plane plate, as shown in FIG. 3C, the contact area between the toner and the partner member is large. For example, when the partner member is a latent image carrier, it results in a lowered transferring rate, because the releasing properties of the toner to the latent image carrier are poor, while transferring dust and scattered toner may be easily cleaned with a cleaning blade, because adherence of the toner to the latent image carrier is large.

On the other hand, according to the toner of the present invention, as shown in FIG. 3B, the contact area between the toner and a glass plane plate is in quasi-line-contact condition where a number of continuous point-contact points continue into a line, i.e. such continuous point-contact points look like a line, and the toner is in a state where at least one contact area satisfying a relation between the long axis L and the minor axis M of (L/M)>3 is included. When the contact between a toner and a latent image carrier is in line-contact condition so that at least one contact surface portion thereof satisfies a relation of (L/M)>3, a high transferring rate can be obtained, because the adherence between the toner and a latent image carrier is not so strong, and the toner shows proper releasing properties to a latent image carrier. Besides, it is possible to prevent transferring dust and improve cleanability, since rolling of the toner can be restrained on a latent image carrier, and proper contact among toner particles can be obtained. With an intermediate transferring member, it is possible that the toner has proper releasing properties and shows a high secondary transferring rate and prevents transferring dust with a moderate adherence. In addition, in a fixing step, proper contact condition with a fixing member such as a fixing roller enables preventing any image defects caused by toner rolling, and it is possible to obtain a high-quality fixed image in which a toner densely aggregated, because toner particles having an average circularity of 0.95 have proper adherences each other Shape Factor: SF-1, SF-2

A toner according to the present invention preferably has a shape factor SF-1 of 110 to 140, and a shape factor SF-2 of 120 to 160.

Figure 4A:
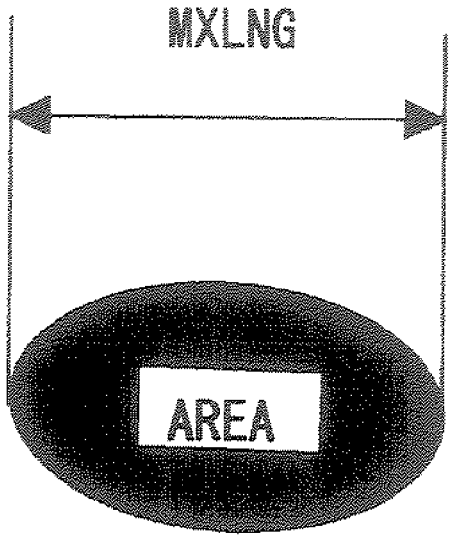
FIG. 4A is a view schematically showing a shape of the toner according to the present invention for illustrating the shape factor SF-1.
Figure 4B:
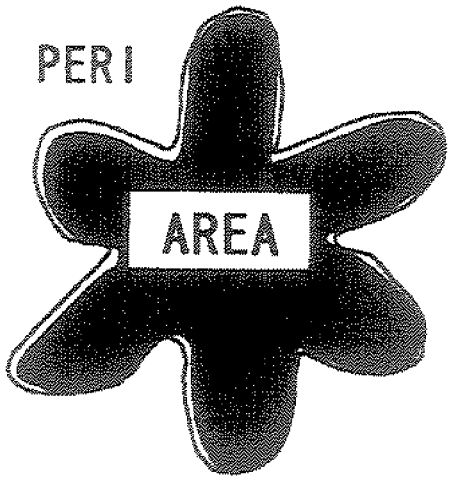
FIG. 4B is a view schematically shoring a shape of the toner according to the present invention for illustrating the shape factor SF-2.

FIGS. 4A and 4B are schematic views respectively showing a shape of toner to illustrate the shape factors of SF-1 and SF-2. FIG. 4A is a view for illustrating the shape factor SF-1, and FIG. 4B is a view for illustrating the shape factor SF-2.

The shape factors SF-1 and SF-2 are represented by the following equations (1) and (2):

$$SF\text{-}1=\{(MXLNG)^2/AREA\}\times(100\,\pi/4) \quad \text{Equation (1)}$$

$$SF\text{-}2=\{(PERI)^2/AREA\}\times(100/4\pi) \quad \text{Equation (2)}$$

When the value of SF-1 is 100, the shape of toner is a perfect sphere, and with increases in the value of SF-1, toner is formed in an indefinite shape. When the value of SF-2 is 100, there is no concave and convex formed on a toner surface, and with increases in the value of SF-2, concave-convex shapes are increasingly prominent.

Here, the shape factor SF-1 is a value obtained by the following processes. One hundred images of toner particles magnified 500 diameters using an electron microscope (for example, FE-SEM (S-800) manufactured by HITACHI Ltd., and the like, hereafter, the same applies) were sampled randomly. The image information was introduced to an image-analyze (for example, nexus NEW CUBE ver 2.5 (manufactured by NEXUS Co., Ltd.), and LuzexIII (NICORE CORPORATION), and the like, hereinafter, the same applies) via an interface and analyzed to thereby obtain a value according to the equation (1).

The shape factor SF-2 is a value obtained by the following processes. Fifty images of toner particles magnified 3,500 diameters using an electron microscope were sampled randomly. The image information was introduced to an image-analyzer via an interface and analyzed to thereby obtain a value according to the equation (2).

When both shape factors of SF-1 and SF-2 are close to 100 and the toner shape is close to a perfect sphere, the contact surface portions between toner particles each other, or between toner particles and a latent image carrier have point-contact. Thus, the absorption force between toner particles is weaken, resulting in higher fluidity and weak absorption force between the toner and the latent image carrier, a higher transferring rate, and excellent dot-reproductivity. At the same time, the shape factors of SF-1 and SF2 are preferred to be some degree of greater values, because a cleaning-margin level increases, causing no troubles such as cleaning defects.

<Production Method of Toner>

Examples of the toner according to the present invention include the ones prepared by using the following constitutional materials.

Modified Polyester

The toner of the present invention comprises a modified polyester (i) as a binder resin. A modified polyester (i) indicates a state of a polyester in which a combined group other than ester bond may reside in a polyester resin, and different resin components are combined into a polyester resin through covalent bond, ionic bond or the like. Specifically, examples of the modified polyester include the one that functional groups such as isocyanate groups which react to carboxylic acid groups and hydrogen groups are introduced to a polyester end and further reacted to an active hydrogen-containing compound to modify the polyester end. It is preferably a urea-modified polyester which is obtained by a reaction between a polyester prepolymer having isocyanate groups and amines. Examples of the polyester prepolymer having isocyanate groups include polyester prepolymers which are polycondensation polyesters of polyvalent alcohols and polyvalent carboxylic acids and produced by which polyesters having active hydrogen groups are further reacted to a polyvalent isocyanate compound. Examples of the active hydrogen groups obtained by the polyesters are hydroxyl groups such as alcoholic hydroxyl groups and phenolic hydroxyl groups, amino groups, carboxyl groups, and mercapto groups. Among these groups, alcoholic hydroxyl groups are preferable.

A urea-modified polyester is formed in the following manner.

Examples of the polyvalent alcohol compounds include divalent alcohols, and trivalent or more polyvalent alcohols, and a divalent alcohol alone or mixtures of divalent alcohols with a small amount of trivalent or more polyvalent alcohols are preferable. Examples of the divalent alcohols include alkylene glycols such as ethylene glycol, 1,2-propylene glycol, 1,3-propylene glycol, 1,4-butandiol, and 1,6-hexanediol; alkylene ether glycols such as diethylene glycols, triethylene glycols, dipropylene glycols, polyethylene glycols, polypropylene glycols, and polytetramethylene ether glycols; alicyclic diols such as 1,4-cyclohexane dimethanol, and hydrogenated bisphenol A; bisphenols such as bispheonol A, bisphenol F, and bisphenol S; alkylene oxide adducts of the above-noted alicyclic diols such as ethylene oxides, propylene oxides, and butylene oxides; and alkylene oxide adducts of the above-noted bisphenols such as ethylene oxides, propylene oxides, and butylene oxides. Among the above mentioned, alkylene glycols having carbon atoms 2 to 12 and alkylene oxide adducts of the bisphenols are preferable. Alkylene oxide adducts of bisphenols and combinations of these adduct with alkylene glycols each having carbon atoms 2 to 12 are particularly preferable. Examples of the trivalent or more polyvalent alcohols include polyaliphatic alcohols of trivalent to octavalent or more such as glycerine, trimethylol ethane, trimethylol propane, pentaerythritol, and sorbitol; and trivalent or more phenols such as trisphenol PA, phenol novolac, and cresol novolac; and alkylene oxide adducts of the trivalent or more polyphenols.

Examples of the polyvalent carboxylic acid include divalent carboxylic acids and trivalent or more polyvalent carboxylic acids, and a divalent carboxylic acid alone or mixtures of divalent carboxylic acids with a small amount of trivalent or more polyvalent carboxylic acids are preferable. Examples of the divalent carboxylic acid include alkylene dicarboxylic acids such as succinic acids, adipic acids, and sebacic acids; alkenylen dicarboxylic acids such as maleic acid, and fumaric acid; aromatic dicarboxylic acids such as phthalic acids, isophthalic acids, terephthalic acids, and naphthalene dicarboxylic acids. Among these divalent carboxylic acids, alkenylen dicarboxylic acids having carbon atoms 4 to 20 and aromatic dicarboxylic acids having carbon atoms 8 to 20 are preferable. Examples of the trivalent or more polyvalent carboxylic acid include aromatic polyvalent carboxylic acids having carbon atoms 9 to 20 such as trimellitic acid, and pyromellitic acid. It is noted that for the polyvalent carboxylic acids, acid anhydrides of the above-noted polyvalent carboxylic acids or lower alkyl esters such as methyl esters, ethyl esters, and isopropyl esters may be used to react to polyvalent alcohols.

A ratio of a polyvalent alcohol to a polyvalent carboxylic acid, defined as an equivalent ratio [OH]/[COOH] of a hydroxyl group [OH] to a carboxyl group [COOH], is typically 2/1 to 1/1, preferably 1.5/1 to 1/1, and more preferably 1.3/1 to 1.02/1.

Examples of the polyvalent isocyanate compounds include aliphatic polyvalent isocyanates such as tetramethylen diisocyanate, hexamethylen diisocyanate, and 2,6-diisocyanate methyl caproate; alicyclic polyisocyanates such as isophorone diisocyanate, and cyclohexyl methane diisocyanate; aromatic diisocyanates such as tolylene diisocyanate, and diphenylmethane diisocyanate; aromatic aliphatic diisocyanates such as α, α, α', α'-tetramethyl xylylene diisocyanate; isocyanate; compounds in which the above noted polyisocyanates are blocked with phenol derivatives, oximes, caprolactams, and the like; and combinations of two or more compounds thereof.

A ratio of a polyvalent isocyanate compound, defined as an equivalent ratio [NCO]/[OH] of an isocyanate group [NCO] to a hydroxyl group [OH] of a polyester having a hydroxyl group, is typically 5/1 to 1/1, preferably 4/1 to 1.2/1, and more preferably 2.5/1 to 1.5/1. When [NCO]/[OH] is more than 5, low-temperature image-fixing properties degrade. When the molar ratio of [NCO] is less than 1, when a urea-modified polyester is used, the urea content of ester is reduced, resulting in a degraded hot-offset resistivity.

The components content of polyvalent isocyanate compound of a polyester prepolymer having an isocyanate group is typically 0.5% by mass to 40% by mass, preferably 1% by mass to 30% by mass, and more preferably 2% by mass to 20% by mass. When less than 0.5% by mass, it makes hot-offset resistivity degraded and brings about disadvantages in the compatibility between heat-resistant-storage properties and low-temperature image-fixing properties. On the other hand, when it is more than 40% by mass, low-temperature image-fixing properties degrade. The number of isocyanate groups contained in per one molecular of polyester prepolymer having isocyanate group(s) is typically 1 or more, preferably 1.5 to 3 on an average, and more preferably 1.8 to 2.5 on an average. When the number of isocyanate groups is less than 1 per 1 molecular of polyester prepolymer, the molecular mass of the urea-modified polyester decreases, resulting in degraded hot-offset resistivity.

Next, examples of amines to be reacted to a polyester prepolymer include divalent amine compounds, trivalent or more polyvalent amine compounds, amino alcohols, amino mercaptans, amino acids, and compounds in which the amino groups are blocked.

Examples of the divalent amine compound include aromatic diamines such as phenylene diamines, diethyl toluene diamines 4,4'-diamino diphenyl methane; alicyclic diamines such as 4,4'-diamino-3,3'-dimethyl dicyclohexyl methane, diamine cyclohexane, and isophorone diamine; and aliphatic diamines such as ethylene diamines, tetramethylene diamines, and hexamethylene diamines. Examples of the trivalent or more polyvalent amine compound include diethylene triamine, and triethylene tetramine. Examples of the aminoalcohol include ethanol amines, and hydroxyethylaniline. Examples of the amino mercaptan include aminoethyl mercaptans, and aminopropyl mercaptans. Examples of the amino acid include aminopropionic acids, aminocaproic acids. Examples of the compounds in which the amino groups of divalent amine compounds, trivalent or more polyvalent amine compounds, amino alcohols, and aminomercaptans are blocked include ketimine compounds obtained from the above-noted amines and ketones such as acetone, methyl ethyl ketone, and methyl isobuthyl ketone; and oxazolidine compounds. Among these amines, divalent amine compounds and mixtures of divalent amine compounds with a small amount of trivalent or more polyvalent amine compounds are preferable.

A ratio of amines, defined as an equivalent ratio [NCO]/[NHx] of isocyanate group [NCO] in a polyester prepolymer (A) having isocyanate group to amine group [NHx] in amines, is typically 1/2 to 2/1, preferably 1.5/1 to 1/1.5, and more preferably 1.2/1 to 1/1.2.

When [NCO]/[NHx] is more than 2 or less than ½, the molecular mass of urea-modified polyester decreases, resulting in degraded hot-offset resistivity.

In addition, the urea-modified polyester may include a urethane bond as well as a urea bond. A molar ratio of the urea bond content to the urethane bond content is typically 100/0 to 10/90, preferably 80/20 to 20/80, and more preferably 60/40 to 30/70. When a molar ratio of the urea bond is less than 10%, it results in degraded hot-offset resistivity.

A urea-modified polyester (i) used in the present invention is produced by one-shot method, and prepolymer method. The mass average molecular mass of the urea-modified polyester (i) is typically 10,000 or more, preferably 20,000 to 10,000,000 and more preferably 30,000 to 1,000,000.

The molecular mass peak at the time is preferably 1,000 to 10,000, and when less than 1,000, it is hard to be subjected to elongation reactions, and the elasticity of the toner is low, resulting in degraded hot-offset resistivity. When the molecular mass peak is more than 10,000, it may cause degradation of fixability and may bring hard challenges in yielding toner fine particles and in grinding. The number average molecular mass of the urea-modified polyester (i) when used together with an unmodified polyester (ii), which will be hereinafter described, is not particularly limited, and it may be the number average molecular mass which is easily obtained to be used with the above-noted mass average molecular mass. When a urea-modified polyester (i) is used alone, the number average molecular mass is typically 20,000 or less, preferably 1,000 to 10,000, and more preferably 2,000 to 8,000. When the number average molecular mass is more than 20,000, low-temperature image-fixing properties and gross properties when used in a full-color device degrade.

In cross-linking and/or elongation reactions of a polyester prepolymer (A) and amines in order to obtain a urea-modified polyester (i), a reaction stopper may be used as required to control the molecular mass of a urea-modified polyester to be obtained. Examples of the reaction stopper include monoamines such as diethyl amines, dibutyl amine, buthyl amine, and lauryl amine: and compounds in which the above-noted elements are blocked, i.e. ketimine compounds.

It is noted that the molecular mass of a polymer to be formed can be measured by means of gel permeation chromatography (GPC), using a tetrahydrofuran (THF) solvent.

Unmodified Polyester

In the present invention, not only the urea-modified polyester (i) may be used alone but also an unmodified polyester (ii) may be included together with the urea-modified polyester (i) as binder resin components. Using an unmodified polyester (ii) in combination with a urea-modified polyester (i) is preferable to the use of the urea-modified polyester (i) alone, because low-temperature image-fixing properties and gloss properties are improved when used in a full-color device. Examples of the unmodified polyester (ii) include polycondensation polyesters of polyvalent alcohols and polyvalent carboxylic acids, same as in the urea-modified polyester (i) components. Preferable compounds thereof are also the same as in the urea-modified polyester (i). As for the unmodified polyester (ii), in addition to unmodified polyesters, it may be polymers modified by a chemical bond other than urea bonds, for example, it may be modified by a urethane bond. It is preferable that at least part of a urea-modified polyester (i) be compatible with part of an unmodified polyester (ii), from the perspective of low-temperature image-fixing properties and hot-offset resistivity. Thus, it is preferable that the composition of the urea-modified polyester (i) be similar to that of the unmodified polyester (ii). A mass ratio of a urea-modified polyester (i) to an unmodified polyester (ii) when an unmodified polyester (ii) being included, is typically 5/95 to 80/20, preferably 5/95 to 30/70, more preferably 5/95 to 25/75, and still more preferably 7/93 to 20/80. When the mass ratio of a urea-modified polyester (i) is less than 5%, it makes hot-offset resistivity degraded and brings about disadvantages in compatibility between heat-resistant-storage properties and low-temperature image-fixing properties.

The molecular mass peak of the unmodified polyester (ii) is typically 1,000 to 10,000, preferably 2,000 to 8,000, and more preferably 2,000 to 5,000. When the molecular mass peak of the unmodified polyester (ii) is less than 1,000, heat-resistant-storage properties degrade, and when more than 10,000, low-temperature image-fixing properties degrade. The hydroxyl group value of the unmodified polyester (ii) is preferably 5 or more, more preferably 10 to 120, and still more preferably 20 to 80. When the hydroxyl group value is less than 5, it brings about disadvantages in the compatibility between heat-resistant-storage properties and low-temperature image-fixing properties. The acid value of the unmodified polyester (ii) is preferably 1 to 5, and more preferably 2 to 4 from the perspective of charge property.

The glass transition temperature (Tg) of the binder resin is typically 35° C. to 70° C., and preferably 40° C. to 65° C. When less than 35° C., heat-resistant-storage properties of the toner degrade, and when more than 70° C., low-temperature image-fixing properties are insufficient. The toner of the present invention exhibits proper heat-resistant-storage properties even with a low glass transition temperature, compared to a toner made from a polyester known in the art, because a urea-modified polyester easily exists on the surface of particles of the toner-base to be obtained. It is noted that the glass transition temperature (Tg) can be measured using a differential scanning calorimeter (DSC).

Colorant

With respect to the colorant to be used, all the dyes and pigments known in the art may be used. For example, it is possible to use carbon black, nigrosine dye, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazinelake yellow, quinoline yellow lake, anthraene yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methylviolet lake, cobalt purple, manganese Violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, lithopone, and a mixture thereof. The colorant content to the toner is typically 1% by mass to 15% by mass, and preferably 3% by mass to 10% by mass.

The colorant may be used as a masterbatch compounded with a resin. Examples of the binder resin to be used in producing of a masterbatch, or to be kneaded with a masterbatch include styrenes such as polystyrene, poly-p-chlorostyrene, polyvinyl toluene, and derivative substitution polymers thereof or copolymers of the above-noted styrene and vinyl compounds, polymethyl methacrylates, polybutyl methacrylates, polyvinylchlorides, polyvinyl acetates, polyethylenes, polypropylenes, polyesters, epoxy resins, epoxy polyol resins, polyurethanes, polyamides, polyvinyl butyrals, polyacrylic acid resins, rosins, modified-rosins, terpene resins, aliphatic hydrocarbon resins, alicyclic hydrocarbon resins, aromatic petroleum resins, chlorinated paraffins, and paraffin waxes. Each of these binder resins may be employed alone or in combination of two or more.

The masterbatch may be obtained by applying a high shearing force to a resin and a colorant for masterbatch and by mixing and kneading the components. Here, to improve the interaction between the resin and the colorant, an organic solvent can be used. Besides, a so-called flashing process is preferably used in producing a masterbatch, because in the flashing process, a wet cake of a colorant can be directly used without the necessity of drying. In the flashing process, a colorant-water-paste containing water is mixed and kneaded with a resin and an organic solvent to transfer the colorant to the resin and then to remove the moisture and the organic solvent components. For mixing or kneading as above, a high shearing dispersion device such as a triple roll mill is preferably used.

Charge Controlling Agent

For a charge-controlling agent, those known in the art can be used. Examples of the charge-controlling agent include nigrosine dyes, triphenylmethane dyes, chrome-contained metal-complex dyes, molybdic acid chelate pigments, rhodamine dyes, alkoxy amines, quaternary ammonium salts including fluoride-modified quaternary ammonium salts, alkylamides, phosphoric simplex or compounds thereof, tungsten simplex or compounds thereof, fluoride activators, salicylic acid metallic salts, and salicylic acid derivative metallic salts. Specifically, Bontron 03 being a nigrosine dye, Bontron P-51 being a quaternary ammonium salt, Bontron S-34 being a metal containing azo dye, Bontron E-82 being an oxynaphthoic acid metal complex, Bontron E-84 being a salicylic acid metal complex, and Bontron E-89 being a phenol condensate (manufactured by Orient Chemical Industries, Ltd.); TP-302 and TP-415 being a quaternary ammonium salt molybdenum metal complex (manufactured by HODOGAYA CHEMICAL CO., LTD.); Copy Charge PSY VP2038 being a quaternary ammonium salt, Copy Blue PR being a triphenylmethane derivative, and Copy Charge NEG VP2036 and Copy Charge NX VP434 being a quaternary ammonium salt (manufactured by Hoechst Ltd.); LRA-901, and LR-147 being a boron metal complex (manufactured by Japan Carlit Co., Ltd.), copper phtalocyamine, perylene, quinacridone, an azo pigment, and other high-molecular mass compounds having a functional group, such as a sulfonic acid group, a carboxyl group, and a quaternary ammonium salt. Among the charge-controlling agents, a substance capable of controlling a toner to a negative polarity is preferably used.

The usage of the charge-controlling agent is determined depending on the type of the used binder resin, the presence or absence of additives to be used as required, and the toner-production method including the dispersion process and is not limited uniformly, however, to 100 parts by mass of binder resin, 0.1 parts by mass to 10 parts by mass of the charge-controlling agent is preferably used and more preferably with 0.2 parts by mass to 5 parts by mass of the charge-controlling agent. When the charge-controlling agent is more than 10 parts by mass, charge property of the toner are exceedingly large, which lessens the effect of the charge-controlling agent itself and increases electrostatic attraction force with a developing roller, and causes degradations of fluidity and image density of a developer.

Releasing Agent

A wax having a melting point of 50° C. to 120° C. which is dispersed in a binder resin more effectively works on the phase boundary between a fixing roller and a toner as a releasing agent in a dispersion liquid with a binder resin dispersed therein. This exerts an effect on high temperature offsets without any applications of a releasing agent like an oil to a fixing roller. The wax components are as follows. Examples of the wax include waxes of vegetable origin such as carnauba wax, cotton wax, sumac wax, and rice wax; waxes of animal origin such as beeswax, and lanoline, and waxes of mineral origin such as ozokerite, and ceresin, and petroleum waxes such as paraffin, micro crystalline, and petrolatum. Besides the above-noted permanent waxes, there are hydrocarbon synthetic waxes such as Fischer-Tropsch wax, polyethylene waxes; and synthetic waxes such as ester waxes, ketone waxes, and ether waxes. Further, it is also possible to use polyacrylate homopolymers such as poly-n-stearyl methacrylate, and poly-n-lauril methacrylate being a fatty acid and low-molecular mass crystalline polymer resins such as 12-hydroxy stearic acid amide, stearic acid amide, phthalic anhydride imide, and chlorinated hydrocarbon or copolymers such as n-stearyl acrylate-ethylmethacrylate copolymer; and crystalline polymers having a long alkyl group in its side chain.

The above-noted charge-controlling agents and the releasing agents may be fused and kneaded with a masterbatch and binder resins and may be added when dissolved and dispersed into an organic solvent.

Next, a method for producing a toner according to the present invention will be described. Here, a preferable method for producing a toner is described, however, the present invention is not limited to the method described herein.

Method for Producing a Toner Binder

A toner binder may be produced by the following method, and the like. A polyvalent alcohol and a polyvalent carboxylic acid are heated to a temperature of 150° C. to 280° C. in the presence of an esterification catalyst known in the art, such as, tetrabutoxy titanate, and a dibutyltin oxide, and yielded water was removed while depressurizing as needed to obtain a polyester having a hydroxyl group. Next, the obtained polyester is reacted to a polyisocyanate compound at a temperature of 40° C. to 140° C. to obtain a prepolymer having an isocyanate group. Further, the prepolymer is reacted to amines at a temperature of 0° C. to 140° C. to obtain a modified polyester with urea bond (i).

When reacting a polyisocyanate compound and when reacting the prepolymer to an elongating agent and/or a crosslinker such as amines, a solvent may be used if needed. Examples of available solvents include solvents which are inactive to polyisocyanate compounds such as aromatic solvents such as toluene, xylene; ketones such as acetone, methyl ethyl ketone, methyl isobutyl ketone; esters such as ethyl acetate; amides such as dimethylformamide, and dimethylacetamide; and ethers such as tetrahydrofuran.

When an unmodified polyester (ii) is used in combination with the urea-modified polyester (i), an unmodified polyester (ii) is produced in a similar manner as the polyester having a hydroxyl acid group, and the obtained polyester is melted into a solvent which has been subjected to the reactions as in the urea-modified polyester (i) and then mixed.

Method for Manufacturing a Toner

1) A colorant, an unmodified polyester (i), a polyester prepolymer (A) having an isocyanate group, a releasing agent, and inorganic filler are dispersed into an organic solvent to prepare a toner materials-contained solution.

As to the organic solvent, an organic solvent being volatile and having a boiling point of less than 100° C. is preferable in terms of ease of removability after toner base particles being formed. Specifically, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone and the like may be used alone or in combination with two or more. Particularly, an aromatic solvent such as, toluene, xylene, and a halogenated hydrocarbon, such as, 1,2-dichloroethane, chloroform, and other components such as ethyl acetate and methyl ethyl ketone, are preferable. The usage of the organic solvent to 100 parts by mass of the polyester prepolymer (A) is typically 1 part by mass to 300 parts by mass, preferably 1 part by mass to 100 parts by mass, and more preferably 25 parts by mass to 70 parts by mass.

The inorganic filler exists in the vicinity of surfaces of the toner-base particles to assume the roll of controlling a shape of the toner-base particles in the course of production.

2) The toner materials-contained solution is emulsified in an aqueous medium in the presence of a surfactant and resin fine particles. The aqueous medium may be water alone or may comprise an organic solvent made from alcohols such as methanols, isopropyl alcohols, ethylene glycols; dimethylformamide; tetrahydrofuran; and Cellosolves such as methyl cellosolve; and lower ketones such as acetone, and methyl ethyl ketone.

The amount of the aqueous medium is generally 50 parts by mass to 2,000 parts by mass, and preferably 100 parts by mass to 1,000 parts by mass relative to 100 parts by mass of the toner materials-contained solution. When the amount of aqueous medium is less than 50 parts by mass, the toner materials-contained solution may not be dispersed sufficiently, and the resulting toner particles may not have a predetermined particle diameter. When it is more than 2,000 parts by mass, it is unfavorable in terms of cost reduction.

Where necessary, a dispersing agent such as surfactants and resin fine particles can be used for better particle size distribution and more stable dispersion in the aqueous medium.

Examples of the surfactants include anionic surfactants such as alkyl benzene sulphonates, α-olefin sulphonates, and phosphoric esters; amine salt cationic surfactants such as alkylamine salts, amino alcohol fatty acid derivatives, polyamine fatty acid derivatives, and imidazoline; quaternary ammonium salt cationic surfactants such as alkyltrimethylammonium salts, dialkyldimethylammonium salts, alkyldimethylbenzylammonium salts, pyridinium salts, alkylisoquinolinum salts, and benzethonium chloride; nonionic surfactants such as fatty acid amide derivatives, and polyhydric alcohol derivatives; and amphoteric surfactants such as alanine, dedecyldi(aminoethyl) glycine, di(octylaminoethyl) glycine, N-alkyl-N, and N-dimethylammonium betaine.

The effects of the surfactants can be obtained in a small amount by using a surfactant having a fluoroalkyl group. Preferred examples of anionic surfactants having a fluoroalkyl group are fluoroalkyl carboxylic acids each containing 2 to 10 carbon atoms, and metallic salts thereof, disodium perfluorooctanesulfonyl glutaminate, sodium 3-[ω-fluoroalkyl (carbon atoms 6 to 11) oxy]-1-alkyl (carbon atoms 3 to 4) sulfonate, sodium 3-[ω-fluoroalkanoyl (carbon atoms 6 to 8)-N-ethylamino]-1-propanesulfonate, fluoroalkyl (carbon atoms 11 to 20) carboxylic acids and metallic salts thereof, perfluoroalkyl carboxylic acids (carbon atoms 7 to 13), and metallic salts thereof, perfluoroalkyl (carbon atoms 4 to 12) sulfonic acids and metallic salts thereof, perfluorooctanesulfonic acid diethanolamide, N-propyl-N-(2-hydroxyethyl) perfluorooctanesulfonamide, perfluoroalkyl (carbon atoms 6 to 10) sulfonamide propyl trimethyl ammonium salts, perfluoroalkyl (carbon atoms 6 to 10)-N-ethylsulfonyl glycine salts, and monoperfluoroalkyl (carbon atoms 6 to 16) ethyl phosphoric esters. Such fluoroalkyl-containing anionic surfactants are commercially available under the trade names of, for example, Surflon S-111, S-112, and S-113 (manufactured by ASAHI GLASS CO., LTD.); Fluorad FC-93 FC-95, FC-98, and FC-129 (manufactured by Sumitomo 3M Ltd.); Unidyne DS-101, and DS-102 (manufactured by DAIKIN INDUSTRIES, LTD.); Megafac F-110, F-120, F-113, F-191, F-812, and F-833 (manufactured by Dainippon Ink & Chemicals, Inc.); EFTOP EF-102, 103, 104, 105, 112, 123A, 123B, 306A, 501, 201, and 204 (manufactured by JEMCO Inc.); and FTERGENT F-100 and F150 (manufactured by NEOS Co., Ltd).

Examples of fluoroalkyl-containing cationic surfactants for use in the present invention include aliphatic primary, secondary and tertiary amine acids each having a fluoroalkyl group; aliphatic quaternary am onium salts such as perfluoroalkyl (carbon atoms 6 to 10) sulfonamide propyltrimethyl ammonium salts; benzalkonium salts, benzethonium chloride, pyridinium salts and imidazolium salts. Such fluoroalkyl-containing cationic surfactants are commercially available, for example, under the trade names of Surflon S-121, (manufactured by ASAHI GLASS CO., LTD.); FLUORAD FC-135 (manufactured by Sumitomo 3M Ltd.); Unidyne DS-202 (manufactured by DAIKIN INDUSTRIES, LTD.); Megafac F-150, F-824 (manufactured by Dainippon Ink & Chemicals, Inc.); EFTOP EF-132 (manufactured by JEMCO Inc.); and FTERGENT F-300 (manufactured by NEOS Co., Ltd).

The resin fine particles are used for stabilizing the toner-base particles to be formed in the aqueous medium. To this end, it is preferable to add resin fine particles so that each toner base particle has a surface coverage of 10% to 90%. Examples of such resin fine particles include 1 μm and 3 μm of poly(methyl methacrylate) fine particles, 0.5 μm and 2 μm of polystyrene fine particles, and 1 μm of poly(styrene-acrylonitrile) fine particles. These resin fine particles are commercially available, for example, under the trade names of PB-200H (manufactured by KAO CORPORATION); SGP (manufactured by Soken Chemical & Engineering Co., Ltd.); Techno Polymer SB (manufactured by SEKISUI CHEMICAL CO., LTD); SGP-3G (manufactured by Soken Chemical & Engineering Co., Ltd.); and Micro Pearl (manufactured by SEKISUI CHEMICAL CO., LTD).

In addition, inorganic compounds such as tricalcium phosphate, calcium carbonate, titanium oxide, colloidal silica, and hydroxyl apatite can be also used as the dispersing agent.

For dispersing agents which can be used in combination with the resin fine particles and inorganic compound dispersing agents, the following ones may be used for further stabilizing the dispersion droplets. Examples of the dispersing agents thereof include homopolymers and copolymers of acids such as acrylic acid, methacrylic acid, α-cyanoacrylic acid, α-cyanomethacrylic acid, itaconic acid, crotonic acid, fumaric acid, maleic acid, and maleic anhydride; hydroxyl-group-containing (meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerol monoacrylic ester, glycerol monomethacrylic ester, N-methylolacrylamide, and N-methylolmethacrylamide; vinyl alcohol and esters thereof such as vinyl methyl ether, vinyl ethyl ether, and vinyl propyl ether; esters of vinyl alcohol and a carboxyl-group-containing compound such as vinyl acetate, vinyl propionate, and vinyl butyrate; acrylamide, methacrylamide, diacetone acrylamide, and methylol compounds thereof; acid chlorides such as acryloyl chloride, and methacryloyl chloride; nitrogen-containing or heterocyclic compounds such as vinylpyridine, vinylpyrrolidone, vinylimidazole, and ethyleneimine; polyoxyethylene compounds such as polyoxyethylene, polyoxypropylene, polyoxyethylene alkyl amines, polyoxypropylene alkyl amines, polyoxyethylene alkyl amides, polyoxypropylene alkyl amides, polyoxyethylene nonyl phenyl ether, polyoxyethylene lauryl phenyl ether, polyoxyethylene stearyl phenyl ester, and polyoxyethylene nonyl phenyl ester; and celluloses such as methyl cellulose, hydroxymethyl cellulose, and hydroxypropyl cellulose.

The dispersing procedure is not particularly limited and includes well-known procedures such as low-speed shearing, high-speed shearing, dispersing by friction, high-pressure jetting, ultrasonic dispersion. To allow the dispersed particles to have a particle diameter of 2 μm to 20 μm, the high-speed shearing procedure is preferred. When a high-speed shearing dispersing machine is used, the number of rotation is not particularly limited and is generally from 1,000 rpm to 30,000 rpm, and preferably from 5,000 rpm to 20,000 rpm. The amount of dispersion time is not particularly limited and is generally from 0.1 minutes to 5 minutes in a batch system. The dispersing temperature is generally from 0° C. to 150° C. under pressures, and preferably from 40° C. to 98° C.

3) In parallel with preparation of the emulsified liquid, amines are added to the emulsified liquid to be reacted to a polyester prepolymer (A) having an isocyanate group.

The reaction is involved in cross-linking and/or elongation of molecular chains. The reaction time for cross-linking and/or elongation is appropriately set depending on the reactivity derived from the combination of the isocyanate structure of the polyester prepolymer (A) and the amines and is generally from 10 minutes to 40 hours, and preferably 2 hours to 24 hours.

The reaction temperature is generally 0° C. to 150° C., and preferably 40° C. to 98° C. Where necessary, a catalyst known in the art may be used as required. Specifically, examples of the catalyst include dibutyltin laurate, and dioctyltin laurate.

4) After completion of the reaction, the organic solvent and/or water is removed from the emulsified dispersion i.e. the reaction mixture, and the residue is washed and dried to obtain toner-base particles.

The entire system is gradually raised in temperature while stirring as a laminar flow, is vigorously stirred at set temperature, and the organic solvent is removed to thereby yield toner-base particles. When the ones that are soluble to acids such as calcium phosphate salts or soluble to alkali are used as the dispersion stabilizer calcium phosphate salts can be removed from toner-base particles by dissolving calcium phosphate salts with acids such as hydrochloric acid and then washing it out. Alternatively, the component can be removed, for example, by enzymatic decomposition.

5) A charge-controlling agent is implanted into the obtained toner-base particles using HENSCHEL MIXER at 50,000 rpm to 60,000 rpm for ten minutes, and charge-measurements and the observation of the surface of toner-base particles through the use of a scanning electron microscope (SEM) are performed. Next, inorganic fine particles having the primary fine particles of a volume mean diameter being 90 nm to 300 nm, and if needed, silica fine particles, and titanium oxide fine particles are added to the toner-base particles as external additives and thereby yield a toner.

Inorganic fine particles are externally added according to a conventional procedure using a mixer, or the like.

These processes enable a toner having a small particle diameter with sharp particle size distribution and having concaves-convexes-formed on the surface and the average circularity of 0.95.

The toner of the present invention can be used as a two-component developer by mixing it with magnetic carriers. In this case, the content ratio of the carriers to the toner in the developer is preferably 100 parts by mass of carriers to 1 part by mass to 10 parts by mass of toner. For the magnetic carriers, those having a particle diameter of 20 μm to 200 μm, known in the art such as an iron powder, a ferrite powder, a magnetite powder, and a magnetic resin carrier, may be used. Examples of coating material of the toner include amino resins such as urea-formaldehyde resins, melamine resins, benzoguanamine resins, urea resins, polyamide resins, and epoxy resins. For the coating material, it is also possible to use polyvinyl resins and polyvinylidene resins such as acrylic resins, polymethyl methacrylate resins, polyacrylonitrile resins, polyvinyl acetate resins, polyvinyl alcohol resins, and polyvinyl butyral resins; polystyrene resins such as polystyrene resins, and styrene-acryl copolymer resins; halogenated olefin resins such as polyvinyl chloride; polyester resins such as polyethylene terephthalate resins, and polybutylene terephthalate resins; polycarbonate resins, polyethylene resins, polyvinyl fluoride resins, polyvinylidene fluoride resins, polytrifluoro ethylene resins, polyhexafluoro propylene resins, copolymers of vinylidene fluorides and acryl monomers, copolymers of vinylidene fluorides and vinyl fluorides; fluorotarpolymers such as tarpolymer of tetrafluoro ethylene and vinylidene fluoride and non-fluoride monomer; and silicon resins. In addition, a conductive powder may be included in the coating resin material in accordance with the necessity. As for the conductive powder, metal powder, carbon black, titanium oxides, tin oxides, zinc oxides or the like can be used. The average particle diameter of these conductive powders is preferably 1 μm or less. When the average particle diameter is more than 1 μm, it is difficult to control electric resistivity.

In addition, the toner of the present invention can be used as a one-component and non-magnetic toner in which no carrier is used.

(Image Forming Apparatus and Image Forming Method)

An image forming apparatus according to the present invention comprises a latent image carrier configured to carry a latent image; a charging unit configured to give an electrostatic charge uniformly to the surface of the latent image carrier; an exposing unit configured to expose the charged surface of the latent image carrier based on the image data to form in a latent electrostatic image; a developing unit configured to develop the latent electrostatic image formed on the surface of the latent image carrier into a visible image by supplying a toner to the latent electrostatic image; a transferring unit configured to transfer the visible image on the surface of the latent image carrier onto a recording medium; a fixing unit configured to fix the visible image on the recording medium; and further comprises other units in accordance with the necessity.

The toner is the toner according to the present invention.

An image forming method according to the present invention comprises a charging step for giving an electrostatic charge uniformly to the surface of the latent image carrier; an exposing step for exposing the charged surface of the latent image carrier based on the image data to form in a latent electrostatic image; a developing step for developing the latent electrostatic image formed on the surface of the latent image carrier into a visible image by supplying a toner to the latent electrostatic image; a transferring step for transferring the visible image on the surface of the latent image carrier onto a recording medium; a fixing step for fixing the visible image on the recording medium; and further comprises other steps in accordance with the necessity.

The toner is the toner according to the present invention.

Figure 5:
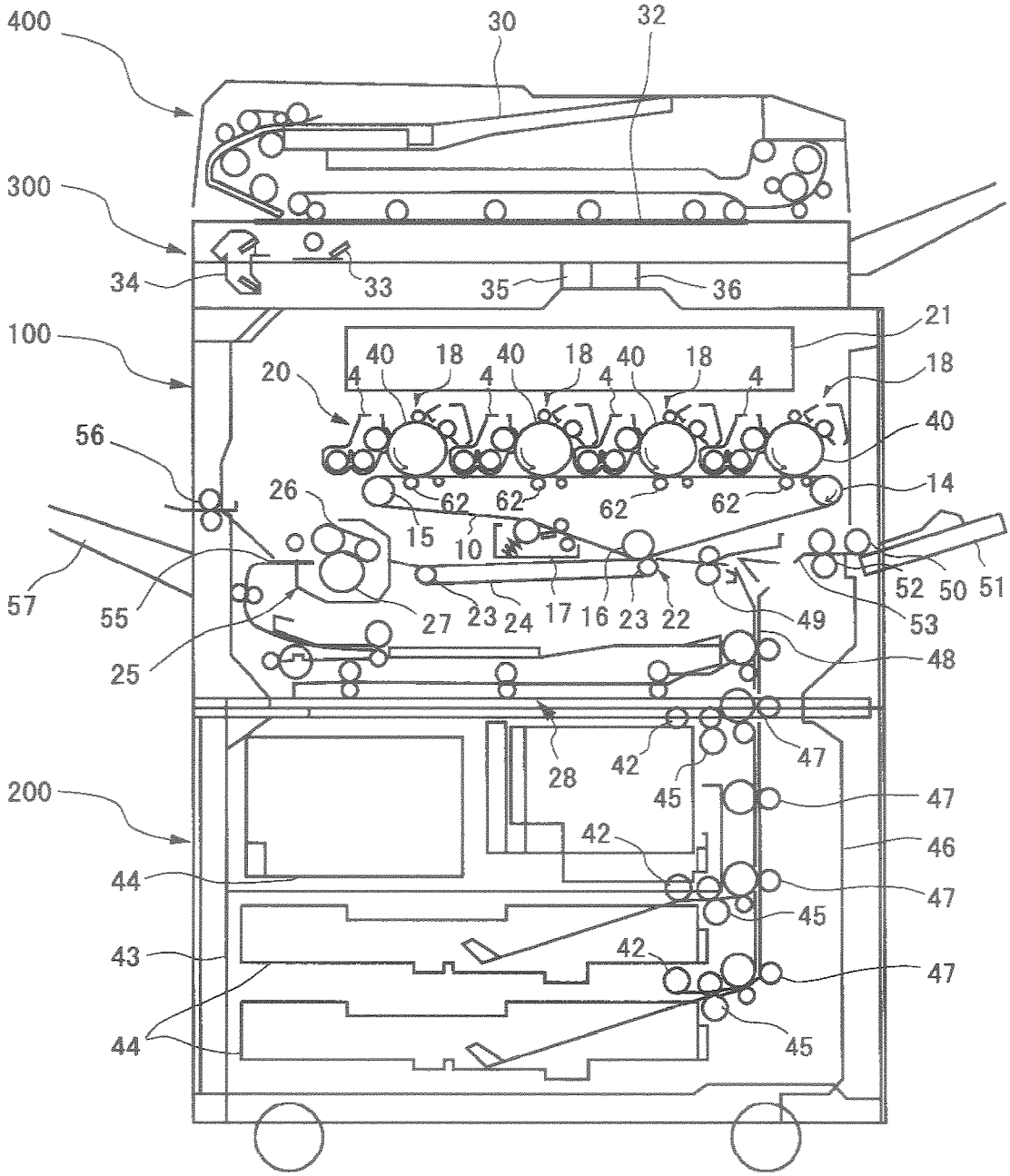
FIG. 5 is a schematic block diagram showing an example of an image forming apparatus according to the present invention.

Hereinafter, the image forming apparatus in which the toner of the present invention is used as a developer will be described. FIG. 5 is a block diagram schematically showing an example of the image forming apparatus relating to the present invention. In FIG. 5, the image forming apparatus comprises copier main body 100, sheet-feeder table 200 configured to carry the main body thereon, scanner 300 configured to be mounted on the copier main body 100, automatic document feeder (ADF) 400 configured to be further mounted on the scanner 300.

The copier main body 100 comprises a tandem-image-forming apparatus 20 having image forming units 18 in which individual units for performing electrophotographic processes, such as, a charging unit, a developing unit, and a cleaner, are included and arranged in four parallel lines around photoconductor 40 as a latent electrostatic image carrier. On the upper side of the tandem-image-forming apparatus 20, exposing unit 21 configured to expose the photoconductor 40 based on image information by a laser beam to form a latent image is mounted. Intermediate transferring belt 10 made from an endless belt member is arranged such that the intermediate transferring belt 10 faces each photoconductor 40 in the tandem-image-forming apparatus 20. At the positions opposed to each photoconductor 40 through the intermediate transferring belt 10, primary-transferring units 62 configured to transfer a toner image formed in each color on the photoconductor 40 onto the intermediate transferring belt 10 is located.

Secondary-transfer apparatus 22 configured to transfer the toner image superimposed on the intermediate transferring belt 10 to a transferring paper transported from the sheet-feeder table 200 in block is located beneath the intermediate transferring belt 10. The secondary-transfer apparatus 22 is configured to have secondary-transferring belt 24 being an endless belt which is spanned over two rollers 23 and is located to be pressed against a supporting roller 16 through the intermediate transferring belt 10 to transfer the toner image on the intermediate transferring belt 10 onto a transferring paper.

Image fixing apparatus 25 configured to fix the image on the transferring paper is located beside the secondary-transfer apparatus 22. The image fixing apparatus 25 is configured such that pressure roller 27 is pressed against the fixing belt 26 being an endless belt.

The above-noted secondary-transfer apparatus 22 also comprises a sheet-transportation function in which a transferring paper with an image transferred thereon is transported to the image fixing apparatus 25. Of course, a transferring roller and a noncontact charging unit may be located in the secondary-transfer apparatus 22. In such a case, it is difficult to provide with the sheet-transportation function.

In the example as shown in the figure, sheet-reversing apparatus 28 that flips a sheet upside down in order to record images on both sides of the sheet is located below the secondary-transfer apparatus 22 and the image fixing apparatus 25 and parallel to the tandem-image-forming device 20.

A developer with the above-noted toner included therein is used for image developing apparatus 4 in the image forming unit 18. In the image developing apparatus 4, a developer-carrier carries and transports a developer to the position where the image developing apparatus 4 faces the photoconductor 40 and applies an alternating electric field to the photoconductor 40 then to develop a latent image on the photoconductor 40. Applying an alternating electric field enables activating a developer and narrowing down distribution of toner charge volume and to improve developing properties.

The image developing apparatus 4 may be a process cartridge configured to be supported with the photoconductor 40 in a single body and detachably mounted to the main body of the image forming apparatus. In addition, the process cartridge may comprise a charging unit and a cleaner.

Actions of the image forming apparatus are as follows.

First, an original document is set on document table 30 of automatic document feeder 400. Or, alternatively, the automatic document feeder 400 may be opened to set the document on contact glass 32 of the scanner 300 and closed thereafter to hold down the document inside thereof.

Then, by pressing a start switch (not shown), the scanner 300 is activated and first moving body 33 and second moving body 34 start to move after the document is carried onto the contact glass 32 if it is set in the automatic document feeder 400, or, immediately after the start switch is pressed if the document is place on the contact glass 32. Thereafter, a laser beam is irradiated from a light source in the first moving body 33, and a reflected laser beam from the document is once again reflected to the first moving body 33 toward the second moving body 34. Mirrors in the second moving body 34 reflect the laser beam toward a reading sensor 36 through an imaging lens 35 and thus the content of the document is read.

By pressing the start switch (not shown), a drive motor (not shown) rotationally drives one of the supporting rollers 14, 15, and 16, and indirectly rotates two other supporting rollers so that the intermediate transferring belt 10 is rotationally moved. At the same time, at each image forming units 18, its photoconductor 40 rotates, and monochrome images of black, yellow, magenta, and cyan are formed on each photoconductor 40. Then, as the intermediate transferring belt 10 moves, these monochrome images are successively transferred to form a composite color image on the intermediate transferring belt 10.

Also, by pressing the start switch (not shown), one of sheet-feeder rollers 42 of the sheet feeder table 200 is selected and driven so as to advance a sheet from one of sheet-feeder cassettes 44 that are stacked in multi-step vertically in a paper bank 43. The sheet is singly separated from other sheets by a separating roller 45 and advanced to a sheet-feeder path 46. Then, carrying roller 47 carries the sheet to guide the sheet to a sheet feeder path 48 in the copier main body 100 where the sheet hits a resist roller 49 and is stopped.

Alternatively, sheet-feeder roller 50 is rotated to advance a sheet from a manual bypass tray 51. Then, a separating roller 52 separates the sheet singly from other sheets and introduces the sheet to a manual-bypass-sheet-feeder path 53 where the sheet hits a resist roller 49 and is stopped.

Then, the resist roller 49 rotates in time with the composite color image on the intermediate transferring belt 10 and advances the sheet between the intermediate transferring belt 10 and the secondary-transfer apparatus 22 where the secondary-transfer apparatus 22 transfers the composite color image onto the sheet to record the color image.

After the image transfer, the secondary-transfer apparatus 22 carries the sheet to the image fixing apparatus 25 where the image fixing apparatus 25 applies heat and pressure to fix the transferred image. Thereafter, a switching flap 55 switches so that the sheet is ejected by an ejecting roller 56 and stacked on a paper output tray 57. Alternatively the sheet changes its direction by action of switch blade 55 into sheet reverser 28, turns therein, and is transported again to the transfer position, followed by image formation on the backside of the sheet. The sheet bearing images on both sides thereof is ejected through the ejecting roller 56 and then stacked onto the output tray 57.

After image transfer, the intermediate-transferring-belt cleaner 17 removes residual toner remaining on the intermediate transferring belt 10 so that the intermediate transferring belt 10 is ready for the next image forming by the tandem-image-forming apparatus 20.

(Process Cartridge)

A process cartridge according to the present invention comprises a latent image carrier configured to carry a latent image, and a developing unit configured to develop the latent electrostatic image formed on the surface of the latent image carrier into a visible image by supplying a toner to the latent electrostatic image, at least the latent image carrier and the developing unit are formed in a single body and detachably mounted to the main body of an image forming apparatus, and the process cartridge further comprises other units suitably selected in accordance with the necessity.

The developing unit comprises a developer-container for housing the toner and the developer, a developer-carrier configured to carry and deliver the toner and the developer housed in the developer-container and may comprise a layer-thickness-controlling member configured to control the thickness of a layer of the toner with the image carried thereon.

Figure 6:
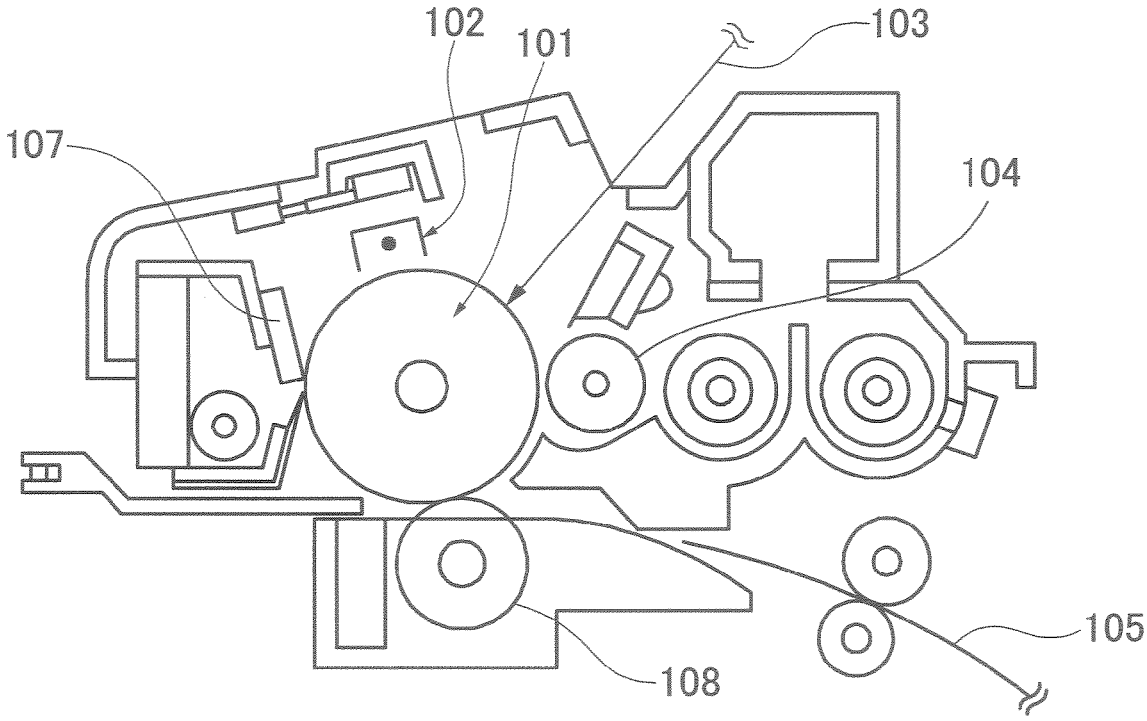
FIG. 6 is a schematic diagram showing an example of a process cartridge according to the present invention.

The process cartridge incorporates, for example, as shown in FIG. 6, photoconductor 101 therein and comprises charging unit 102, developing unit 104, cleaner 107 and further comprises other units in accordance with the necessity. The numbers 103, 105, and 108 respectively represent an exposing unit, a recording medium, and a transporting-roller.

For the photoconductor 101, the above-noted latent electrostatic image carrier according to the present invention is used. For the exposing unit 103, a light source capable of writing at a high resolution is used. For the charging unit 102, an arbitrarily selected charging member is used.

An image forming apparatus according to the present invention comprises the latent electrostatic image carrier and components such as a developing unit and a cleaner formed in a single body as a process cartridge, and the unit may be detachably mounted to the main body of the image forming apparatus. At least one component from a charging unit, a developing unit, an intermediate transferring member or separating roller, and a cleaner are supported with the latent electrostatic image carrier in a single body to form a process cartridge to be a single unit detachably mounted to the main body of the image forming apparatus by using a guiding unit such as a rail equipped with the main body of the image forming apparatus.

The toner according to the present invention can be suitably used for a tandem full-color image forming apparatus having an intermediate transferring member as shown in FIG. 5, since it excels in transferring properties and demonstrates excellent fixability.

In the present invention, by controlling the surface shape of a toner so that adherence between the toner and each member can be in a moderate range in individual steps in the image forming process and by making the toner containing inorganic fine particles each having a volume mean diameter of 90 nm to 300 nm, it is possible to provide a toner capable of demonstrating excellent transferring properties, fixability, and cleanability and forming a high-precision image.

It is also possible to provide a high-quality and high-precision image through the use of an image developing apparatus and an image forming apparatus in which a toner according to the present invention is used.

Hereinafter, the present invention will be described in detail referring to specific examples, however, the present invention is not limited to the disclosed examples.

Example A-1

Preparation of Spherical and Hydrophobic Silica

Tetramethoxysilane and ammonia water were reacted each other at 50° C. to yield a spherical silica according to a sol-gel process. After washing the silica with water, the silica was rinsed with methanol and then dispersed in a toluene without performing drying operations, followed by a hexamethyldisilazane (HMDS) treatment to yield inorganic oxide particles 1. The inorganic oxide particles were stirred in methanol using an ultrasonic dispersing apparatus, and the number average diameter thereof was measured by a laser-diffraction-scattering-particle-size-distribution sizer. The resultant number average diameter of the primary particles was 120 nm.

Synthesis of Organic Fine Particle Emulsion

To a reaction vessel provided with a stirrer and a thermometer, 683 parts by mass of water, 11 parts by mass of sodium salt of the sulfuric acid ester of methacrylic acid ethylene oxide adduct (ELEMINOL RS-30, manufactured by Sanyo Chemical Industries. Ltd.), 83 parts by mass of styrene, 83 parts by mass of methacrylic acid, 110 parts by mass of butyl acrylate, and 1 part by mass of ammonium persulphate were poured, and stirred at 400 rpm for 15 minutes to obtain a white emulsion. The white emulsion was heated, the temperature in the system was raised to 75° C. and the reaction was performed for 5 hours. Next, 30 parts by mass of an aqueous solution of 1% by mass ammonium persulphate was added, and the reaction mixture was matured at 75° C. for 5 hours to obtain an aqueous dispersion liquid of a vinyl resin (copolymer of styrene-methacrylic acid-butyl acrylate-sodium salt of the sulfuric acid ester of methacrylic acid ethylene oxide adduct). This aqueous solution was taken as particulate emulsion 1. The volume average particle diameter of particulate emulsion 1 measured by a laser diffraction particle size distribution analyzer (LA-920, manufactured by HORIBA Instruments Inc.) was 105 nm. After drying part of particulate emulsion 1 and isolating the resin, the glass transition temperature (Tg) of the resin was 59° C. and the mass average molecular mass was 150,000.

Preparation of Aqueous Phase

To 990 parts by mass of water, 80 parts by mass of particulate emulsion 1, 37 parts by mass of a 48.5% by mass aqueous solution of sodium dodecyl diphenylether disulfonic acid (ELEMINOL MON-7, manufactured by Sanyo Chemical Industries, Ltd.) and 90 parts by mass of ethyl acetate were mixed and stirred together to obtain a milky liquid. This was taken as aqueous phase 1.

Synthesis of Low-Molecular-Mass Polyester

In a reaction vessel equipped with a condenser tube, a stirrer, and a nitrogen inlet tube, 229 parts by mass of bisphenol A ethylene oxide dimolar adduct, 529 parts by mass of bisphenol A propylene oxide trimolar adduct, 208 parts by mass of terephthalic acid, 46 parts by mass of adipic acid and 2 parts by mass of dibutyl tin oxide were placed, and the reaction was performed under normal pressure at 230° C. for 8 hours, and the reaction was further performed under a reduced pressure of 10 mmHg to 15 mmHg for 5 hours, then 44 parts by mass of anhydrous trimellitic acid was poured into the reaction vessel, and the reaction was performed at 180° C. under normal pressure for 2 hours to obtain a polyester. This polyester was taken as low-molecular mass polyester 1. Low-molecular mass polyester 1 had a number average molecular mass of 2,500, a mass average molecular mass of 6,700, a glass transition temperature (Tg) of 43° C. and an acid value of 25.

Synthesis of Intermediate Polyester

In a reaction vessel equipped with a condenser tube, a stirrer, and a nitrogen inlet tube, 682 parts by mass of bisphenol A ethylene oxide dimolar adduct, 81 parts by mass of bisphenol A propylene oxide dimolar adduct, 283 parts by mass of terephthalic acid, 22 parts by mass of anhydrous trimellitic acid and 2 parts by mass of dibutyl tin oxide were placed, and the reaction was performed under normal pressure at 230° C. for 8 hours, and then the reaction was further performed under a reduced pressure of 10 mmHg to 15 mmHg for 5 hours to obtain a polyester. This polyester was taken as intermediate polyester 1. Intermediate polyester 1 had a number average molecular mass of 2,100, a mass average molecular mass of 9,500, a glass transition temperature (Tg) of 55° C., an acid value of 0.5 and a hydroxyl value of 51.

Next, 410 parts by mass of intermediate polyester 1, 89 parts by mass of isohorone diisocyanate and 500 parts by mass of ethyl acetate were placed in a reaction vessel equipped with a condenser tube, a stirrer, and a nitrogen inlet tube, and the reaction was performed at 100° C. for 5 hours to obtain a reactant. This reactant was taken as prepolymer 1. The percent by mass of free isocyanate of prepolymer 1 was 1.53% by mass.

Synthesis of Ketimine

Into a reaction vessel equipped with a stirrer and a thermometer, 170 parts by mass of isohorone diamine and 75 parts by mass of methyl ethyl ketone were poured, and the reaction was performed at 50° C. for 5 hours to obtain an amine-blocked substance. This was taken as ketimine compound 1. The amine value of ketimine compound 1 was 418.

Synthesis of Masterbatch

To 1,200 parts by mass of water, 40 parts by mass of carbon black (Regal 400R, manufactured by Cabot Corp.) and 60 parts by mass of polyester resin (RS801, manufactured by Sanyo Chemical Industries, Ltd.) and further 30 parts by mass of water were added and mixed in HENSCHEL MIXER (manufactured by MITSUTI MINING CO., LTD.) then the mixture was kneaded at 150° C. for 30 minutes using two rollers, extrusion cooled and crushed with a pulverizer to obtain a carbon black masterbatch. This was taken as masterbatch 1.

Preparation of Oil Phase

Into a vessel equipped with a stirrer and thermometer, 400 parts by mass of low-molecular mass polyester 1, 110 parts by mass of carnauba wax, and 947 parts by mass of ethyl acetate were poured, and the temperature was raised to 80° C. with stirring, maintained at 80° C. for 5 hours, and cooled to 30° C. in 1 hour. Next, 500 parts by mass of masterbatch 1 and 500 parts by mass of ethyl acetate were poured into the vessel, and mixed for 1 hour to obtain initial material solution 1.

To a vessel, 1,324 parts by mass of initial material solution 1 were transferred, and the wax was dispersed using a bead mill (Ultra Visco Mill, manufactured by AIMEX CO., LTD) under the conditions of a liquid feed rate 1 kg/hr, disk circumferential speed of 6 m/s, 0.5 mm zirconia beads filled at 80% by volume and the dispersion of wax was performed 3 times. Next, 1,324 parts by mass of 65% ethyl acetate solution of low-molecular mass polyester 1 was added to the initial material solution 1 and dispersed in 1 pass by the bead mill under the above-noted conditions to obtain a dispersion liquid. This was taken as pigment-wax dispersion liquid 1.

Emulsification

In a vessel, 1,772 parts by mass of pigment-wax dispersion liquid 1, 100 parts by mass of 50% by mass ethyl acetate solution of prepolymer 1 having a number average molecular mass of 3,800, a mass average molecular mass of 15,000, a glass transition temperature (Tg) of 60° C., an acid value of 0.5, a hydroxyl value of 51, and a free isocyanate content of 1.53% by mass), 8.5 parts by mass of ketimine compound 1 and 6.9 parts by mass or 6% by mass of a filler (Organo Silicasol MEK-ST-UP, the number average particle diameter of the primary particles=12 nm) were placed and mixed at 5,000 rpm for 1 minute by a TK homomixer (manufactured by TOKUSHU KIKA KOGYO CO., LTD.), then 1,200 parts by mass of aqueous phase 1 were added to the vessel and mixed in the TK homomixer at a rotation speed of 10,000 rpm for 20 minutes to obtain an aqueous medium dispersion. This was taken as emulsion slurry 1.

Solvent Removal

Emulsion slurry 1 was placed in a vessel equipped with a stirrer and a thermometer, then the solvent was removed at 30° C. for 8 hours and the product was matured at 45° C. for 4 hours to obtain a dispersion in which the organic solvent is removed. This was taken as dispersion slurry 1.

Rinsing to Drying

After filtering 100 parts by mass of dispersion slurry 1 under reduced pressure, (1): 100 parts by mass of ion exchange water were added to the filter cake, mixed in a TK homomixer at a rotation speed 12,000 rpm for 10 minutes and filtered.

(2): 100 parts by mass of 10% by mass sodium hydroxide solution were added to the filter cake of (1), mixed in a TK homomixer at a rotation speed of 12,000 rpm for 30 minutes and filtered under reduced pressure.

(3): 100 parts by mass of 10% by mass hydrochloric acid were added to the filter cake of (2), mixed in a TK homomixer at a rotation speed of 12,000 rpm for 10 minutes and filtered.

(4): 300 parts by mass of iron exchange water were added to the filter cake of (3), mixed in a TK homomixer at a rotation speed of 12,000 rpm for 10 minutes, and filtered twice to obtain filter cake 1.

Filter cake 1 was dried in a circulating air dryer at 45° C. for 48 hours, and then sieved through a sieve of 75 μm mesh to obtain toner-base particles 1

Addition of External Additives

To 100 parts by mass of the obtained toner-base particles 1, 2 parts by mass of hydrophobized silica (HDKH200, manufactured by Clariant Japan K.K., the number average particle diameter of the primary particles=30 nm) and 1 part by mass of inorganic oxide particles 1 (the number average particle diameter of the primary particles=120 nm, and 1 part by mass of titanium oxide (MT-150A, manufactured by Teika K.K., the number average particle diameter of the primary particles=30 nm) were mixed in an Oster mixer at 12,000 rpm for 1 minute and then sieved through a sieve of 75 μm mesh to obtain a toner. This was taken as toner 1. The thickness of the filler-layer in the toner was 0.01 μm to 0.2 μm.

Example A-2

A toner was obtained in the same manner as in Example A-1, except that the process from rinsing to mixing of external additives was changed to the process under the following conditions.

Rinsing

After filtering 100 parts by mass of dispersion slurry 1 under reduced pressure, (1): 100 parts by mass of ion exchange water were added to the filter cake, mixed in a TK homomixer at a rotation speed of 12,000 rpm for 10 minutes and filtered.

(2): 100 parts by mass of 10% by mass sodium hydroxide solution were added to the filter cake of (1), mixed in a TK homomixer at a rotation speed of 12,000 rpm for 30 minutes and filtered under reduced pressure.

(3): 100 parts by mass of 10% by mass hydrochloric acid were added to the filter cake of (2), mixed in a TK homomixer at a rotation speed of 12,000 rpm for 10 minutes and filtered.

(4): 300 parts by mass of iron exchange water were added to the filter cake of (3), mixed in a TK homomixer at a rotation speed of 12,000 rpm for 10 minutes, and filtered twice to obtain a filter cake.

Mixing of External Additives 1

To 100 parts by mass of the filter cake, 500 parts by mass of ion exchange water were added to obtain [re-dispersion slurry 1]. On the other hand, 2 parts by mass of inorganic oxide particles 1 having a number average particle diameter of the primary particles=120 nm were added to a solution of 0.2 parts by mass of stearylamine acetate, 70 parts by mass of ion exchange water, and 30 parts by mass of methanol by degrees while stirring the solution to obtain a silica-fine-particulate dispersion. The obtained silica-fine particulate dispersion was mixed with the re-dispersion slurry then stirred at room temperature for 1 hour and filtered to obtain a filter cake.

Drying

The filter cake was dried in a circulating air at 45° C. for 48 hours, sieved through a sieve of 75 μm mesh to obtain toner-base particles 2.

Mixing of External Additives 2

100 parts by mass of the obtained toner-base particles 2 and 1.0 part by mass of a hydrophobic silica (HDK 2000H, manufactured by Clariant Japan K.K., the number average particle diameter of the primary particles=12 nm) as an external additive were mixed in HENSCHEL MIXER (fan rotation speed 2,000 rpm, mixing time 30 seconds, 5 cycles, passed through a sieve of 38 μm mesh to remove the aggregated substance to thereby obtain a toner. This was taken as toner 2. The thickness of the filler-layer in the toner was 0.0 μm to 0.2 μm.

Example A-3

Toner 3 was obtained in the same manner as in Example A-1, except that the conditions were changed to the following conditions. The thickness of the filler-layer in the toner was 0.02 μm to 0.2 μm.

Emulsification, Solvent Removal

In a vessel, 749 parts by mass of pigment-wax dispersion liquid 1, 115 parts by mass of prepolymer 1, 2.9 parts by mass of ketimine compound 1 and 100 parts by mass (10% by mass) of a filler (Organo Silicasol MEK-ST-UP, the number average particle diameter of the primary particles=12 nm) were placed and mixed at 5,000 rpm for 2 minute by a TK homomixer (manufactured by TOKUSHU KIKA KOGYO CO., LTD.), then 1,200 parts by mass of aqueous phase 1 were added to the vessel and mixed in the TK homomixer at a rotation speed of 13,000 rpm for 10 minutes to obtain emulsion slurry 2.

Emulsion slurry 2 was placed in a vessel equipped with a stirrer and a thermometer, then the solvent was removed at 30° C. for 6 hours and the product was matured at 45° C. for 5 hours to obtain dispersion slurry 2.

Example A-4

Toner 4 was obtained in the same manner as in Example A-1, except that the conditions for the emulsification to the removal of solvent were changed to the following conditions. The thickness of the filler-layer in the toner was 0.01 μm to 0.2 μm.

Emulsification, Solvent Removal

In a vessel, 749 parts by mass of pigment-wax dispersion liquid 1, 115 parts by mass of prepolymer 1, 2.9 parts by mass of ketimine compound 1 and 100 parts by mass (10% by mass) of a filler (Organo Silicasol MEK-ST-UP, the number average particle diameter of the primary particles=12 nm) were placed and mixed at 5,000 rpm for 2 minute by a TK homomixer (manufactured by TOKUSHU KIKA KOGYO CO., LTD.), then 1,200 parts by mass of aqueous phase 1 were added to the vessel and mixed in the TK homomixer at a rotation speed of 13,000 rpm for 40 minutes to obtain emulsion slurry 3.

Emulsion slurry 3 was placed in a vessel equipped with a stirrer and a thermometer, then the solvent was removed at 30° C. for 8 hours and the product was matured at 45° C. for 5 hours to obtain dispersion slurry 3.

<YMC Other than Carbon Black>

Example A-5

Toner 5 was obtained in the same manner as in Example A-1, except that the carbon black used in Example A-1 was changed to Pigment Red 269. The thickness of the filler-layer in the toner was 0.01 μm to 0.2 μm.

Example A-6

Toner 6 was obtained in the same manner as in Example A-1, except that the carbon black used in Example A-1 was changed to Pigment Blue 15:3. The thickness of the filler-layer in the toner was 0.01 μm to 0.2 μm.

Example A-7

Toner 7 was obtained in the same manner as in Example A-1, except that the carbon black used in Example A-1 was changed to Pigment Yellow 155. The thickness of the filler-layer in the toner was 0.01 μm to 0.2 μm.

Comparative Example A-1

A toner (0% by mass of filler) was obtained in the same manner as in Example A-1, except that Organo Silicasol was not added in the process for preparation of the oil phase.

Comparative Example A-2

A toner (6% by mass of filler) was obtained in the same manner as in Example A-1, except that inorganic oxide particles 1 was not added in the process for mixing of the external additives.

Comparative Example A-3

Preparation of Strontium Titanate

After completely stirring titanium oxide and strontium carbonate using a wet ball mill, the mixture was dried and calcined at 900° C. and then ground by a jet mill to obtain a strontium Titanate having a number average particle diameter of 310 nm.

100 parts by mass of the obtained toner-base particles 1, 2 parts by mass of a hydrophobized silica (HDKH2000, Clariant Japan K.K., the number average particle diameter of the primary particles=30 nm), 1 part by mass of strontium titanate, and 1 part by mass of a titanium oxide (MT-150A manufactured by Teika K.K., the number average particle diameter of the primary particles=30 nm) were mixed in an Oster mixer at 12,000 rpm for 1 minute and them sieved through a sieve of 75 μm mesh to obtain a toner (6% by mass of filler).

Comparative Example A-4

After preliminarily mixing toner-initial materials containing 100 parts by mass of a styrene-n-butyl acrylate copolymer resin, 10 parts by mass of carbon black, and 4 parts by mass of polypropylene in HENSCHEL MIXER, the mixture was fused and kneaded by a biaxial extruder and crushed by a hammer mill and then reduced into a powder by a jet mill to obtain a powder. The obtained powder was dispersed in thermal current of a spray dryer to obtain particles being tuned in shape. The particles were repeatedly classified by a wind force classifier until an intended particle size distribution was obtained. To 100 parts by mass of the obtained and colored particles, 2 parts by mass of a hydrophobized silica (HDKH2000, manufactured by Clariant Japan K.K.), 1 part by mass of inorganic oxide particles 1 (the number average particle diameter of the primary particles=120 nm) and 1 part by mass of titanium oxide (MT-150A, manufactured by Teika K.K.) was added and mixed in HENSCHEL MIXER to obtain a toner (a pulverized toner).

By using the toners obtained in Examples A-1 to A-7, and Comparative Examples A-1 to A-4, images were formed through the use of an image forming apparatus (imagio Neo C385, manufactured by Ricoh Company, Ltd) to evaluate the following items.

(Evaluation Items)

1) Transferring Rate

After transferring a 20% image-area ratio chart to a sheet of paper from a photoconductor, transfer residual toner remaining on the photoconductor immediately before a cleaning step was transferred to a sheet of white paper using a scotch tape (manufactured by Sumitomo 3M Ltd.) to measure the reflection density by a reflection densitometer (Macbeth reflection densitometer RD514). A toner which had a difference in reflection density from that of the blank portion of the paper being less than 0.005 was evaluated as A, a toner which had a difference thereof being 0.005 to 0.010 was evaluated as B, a toner which had a difference thereof being 0.011 to 0.02 was evaluated as C, and a toner which had a difference thereof being more than 0.02 was evaluated as D.

2) Transferring Dust

After checking dust at the time of developing, each toner image on the photoconductor was transferred onto a sheet of paper under the same conditions, and presence or absence of toner on a white line in thin lines of a not-fixed image before fixing step was judged by visual check. A toner which had no problem with its practical use was evaluated as A, a toner which had no problem with its practical use, however, the quality being somewhat inferior to a toner evaluated as B was evaluated as C, and a toner which had some problems with its practical use was evaluated as D.

3) Cleanability

After outputting 1,000 sheets of a 95% image-area ratio chart, transfer residual toner remaining on the photoconductor which had gone through a cleaning step was transferred to a sheet of white paper using a scotch tape (manufactured by Sumitomo 3M Ltd.) to measure the reflection density by a reflection densitometer (Macbeth reflection densitometer RD514). A toner which had a difference in reflection density from that of the blank portion of the paper being less than 0.005 was evaluated as A, a toner which had a difference thereof being 0.005 to 0.010 was evaluated as B, a toner which had a difference thereof being 0.011 to 0.02 was evaluated as C, and a toner which had a difference thereof being more than 0.02 was evaluated as D.

4) Fixability

An imagio Neo 450 image forming apparatus (manufactured by Ricoh Company, Ltd.) was modified and tuned to a system taking a belt fixing approach. Using the modified copier, solid images with an amount of toner adhesion of 1.0±0.1 mg/cm$^2$ were printed on transferring sheets of plain paper and heavy paper (6200 manufactured by Ricoh Company, Ltd. and duplicator printing paper manufactured by NBS Ricoh Company, Ltd.) and evaluated as to its fixability. The fixing test was performed while changing the temperature of the fixing belt, and a highest fixing temperature at which no hot offset occurred on plain paper was taken as the highest fixing temperature. The lowest fixing temperature was also measured using heavy paper. A fixing roll temperature at which the residual ratio of image density after an obtained fixing image rubbed with a pad being 70% or more was taken as the lowest fixing temperature. A toner that satisfied the highest fixing temperature of 190° C. or more and the lowest fixing temperature of 140° C. or less was evaluated as B. A toner that did not satisfy the above-noted condition was evaluated as D.

5) Image Density

After outputting solid images of the images to sheets of paper 6000 (manufactured by Ricoh Company, Ltd.), each image density was measured by an X-Rite (manufactured by X-Rite Inc.). The measurement of the image density was separately performed for each of four colors, and the average value of the four-color image densities was obtained. A toner having the average value thereof being less than 1.2 was evaluated as D. A toner having the average value thereof being 1.2 or more and less than 1.4 was evaluated as C. A toner having the average value thereof being 1.4 or more and less than 1.8 was evaluated as B. A toner having the average value thereof being 1.8 or more and less than 2.2 was evaluated as A.

Tables 1 and 2 show the characteristic values (properties) and evaluation results of the above-mentioned individual toners. Other evaluation items include existence ratio of inorganic fine particles $X_{surf}$ and $X_{total}$, average circularity of toner particles, SF-2 and the like, which are shown in Table 1.

Existence Ratio of Inorganic Fine Particles of $X_{surf}$ and $X_{total}$

In a vessel, 67% by mass of the toner was dispersed in a sucrose-saturated aqueous solution and frozen at −100° C., and then sliced so as to have a wall thickness of 1,000 angstrom using a cryomicrotome (EM-FCS, manufactured by Laica). Pictures of the cross-sectional surfaces of toner particles were taken at 10,000-fold magnification using a transmission electron microscope (JEM-2010, manufactured by JEOL Ltd.). Using an image analyzer (nexus New CUBE ver 2.5, manufactured by NEXUS Co., Ltd.), in a cross-sectional surface of a toner particle where the cross-sectional area of the toner particle was maximum, the area ratio of shadows of inorganic fine particles in the region of 200 nm in a direction perpendicular to the toner particle from the surface was taken, i.e. $X_{surf}$ was obtained. In addition, the area ratio of shadows of inorganic fine particles in the total area of the cross-sectional area of the toner particle, i.e. $X_{total}$ was obtained. Ten toner particles were selected at random and measured respectively. The average value of these ten toner particles was taken to be the measured values as $X_{surf}$ and $X_{total}$.

SF-2

The toner was magnified at 3,500-fold magnification using a scanning electron microscope (S-4200, manufactured by Hitachi, Ltd.) at an acceleration voltage of 5 kV to select 50 pieces of toner particle images at random. The image information was analyzed by an image analyzer (nexus New CUBE ver. 2.5, manufactured by NEXUS Co., Ltd.) to obtain the shape factor SF-2.

Average Circularity

In a vessel, 0.2 g of the toner and 0.2 ml of a surface active surfactant were added to 100 ml of distilled water and dispersed adequately using an ultrasonic dispersing apparatus. The toner dispersion liquid was measured using a flow-particle-image analyzer (FPIA-2000; manufactured by Sysmex Corp.). The average circularity was measured within an area of a toner particle diameter from 0.6 μm to 400 μm.

The concave-convex shape of each of these toners was evaluated by A/S value measured as the following procedure.

(Measurement of A/S Value)

Glass plane plates used to resemble a pseudo latent image carrier, a pseudo intermediate transferring member, a pseudo fixing member, were prepared and a sieve of 22 μm mesh was set on the glass plate. Each toner was placed on the mesh and the toner was sieved while vibrating the sieve for 10 seconds to uniformly put a little amount of the toner on the glass plate through the mesh. A photo of the glass plane plate held in this state was taken from the bottom of the glass plate using a high-resolution digital ca era (COOL PIX 5000 4,920,000 pixels, manufactured by NICON Corp.). The image taken at that time was an image enabling discerning between the portion that the toner contacted the glass plate surface and the portion that the toner did not contact the glass plate surface. The image picture was scanned into a personal computer to perform an image analysis using an image analyzer (Image-Pro Plus, manufactured by Planetron, Inc.). The area the toner contacting the glass plate surface was blacked out, and the area was defined as A to obtain the area. The outline of the whole toner was drawn with black, and the entire area surrounded with the black line was defined as S to obtain the area. Finally, a value of A/S and L/M can be obtained using the above mentioned values. The image processing stated above was performed for 100 or more sampling toners.

TABLE 2

| | Evaluation Results | | | | |
|---|---|---|---|---|---|
| | Transferring Rate | Transferring Dust | Clean-ability | Fixability | Image Density |
| Ex. A-1 | A | B | B | B | A |
| Ex. A-2 | B | B | B | B | A |
| Ex. A-3 | B | B | B | B | B |
| Ex. A-4 | B | B | B | B | B |
| Ex. A-5 | A | B | B | B | A |
| Ex. A-6 | A | B | B | B | A |
| Ex. A-7 | A | B | B | B | A |
| Compara. Ex. A-1 | A | D | D | B | B |
| Compara. Ex. A-2 | C | B | C | B | B |
| Compara. Ex. A-3 | B | D | B | D | B |
| Compara. Ex. A-4 | D | B | A | D | D |

The results shown in Tables 1 and 2 show that toners of Examples A-1 to A-4 which had an average circularity of 0.95 and a value of A/S ratio of the total contact area between the toner and a latent image carrier (A) to the total projection area of the toner (S) being from 15% to 40% and to which a hydrophobized silica having a number average particle diameter of the primary particles 120 nm was added as an external additive, respectively exemplified excellent results of a high transferring rate, no occurrence of transferring dust, and excellent cleanability because the toners individually contacted with a latent image carrier, an intermediate transferring member and a fixing member moderately. With respect to fixability of the toners, no image defect occurred. The toners also showed excellent results in hot offset resistivity and low-temperature image-fixing properties. In addition, the toners of Examples A-1 to A-4 satisfied a relation of ratio (L/M) of the long axis L and the minor axis M being L/M>3 in the contact surface portion where the toner contacted with a latent image carrier.

On the other hand, the toner of Comparative Example A-1 having a high average circularity and showing a low A/S value of 7.1% and an almost spherical shape showed a considerably

TABLE 1

| | Characteristic Values (Properties) of Toner | | | | | | | | |
|---|---|---|---|---|---|---|---|---|---|
| | X-surface | X-total | Average Circularity | A/S (%) | L/M | SF-2 | Dv | Dv/Dn | Content (%) of particle diameter corresponding to a circle being 2.0 μm or less based on number |
| Ex. A-1 | 65% | 32% | 0.97 | 19.5 | 5 | 132 | 5.4 | 1.28 | 1.2 |
| Ex. A-2 | 65% | 32% | 0.95 | 21.3 | 17 | 137 | 5.1 | 1.16 | 0.9 |
| Ex. A-3 | 91% | 48% | 0.95 | 21.6 | 18 | 138 | 5.1 | 1.17 | 12.6 |
| Ex. A-4 | 82% | 47% | 0.97 | 20.2 | 8 | 124 | 4.3 | 1.16 | 17.6 |
| Ex. A-5 | 58% | 32% | 0.96 | 18.9 | 6 | 130 | 5.3 | 1.26 | 1.7 |
| Ex. A-6 | 55% | 30% | 0.97 | 20.1 | 5 | 133 | 5.5 | 1.22 | 1.1 |
| Ex. A-7 | 58% | 30% | 0.96 | 19.8 | 6 | 129 | 5.2 | 1.21 | 1.4 |
| Compara. Ex. A-1 | 0% | 0% | 0.98 | 7.1 | 3 | 118 | 5.2 | 1.23 | 7.8 |
| Compara. Ex. A-2 | 65% | 32% | 0.97 | 17.5 | 4 | 120 | 5.8 | 1.28 | 5.9 |
| Compara. Ex. A-3 | 65% | 32% | 0.97 | 18.5 | 7 | 132 | 5.4 | 1.28 | 1.2 |
| Compara. Ex. A-4 | 0% | 0% | 0.90 | 47.1 | 37 | 115 | 8.6 | 1.21 | 6.0 |

high transferring rate, however, brought about transferring dust, which caused image defects. In addition, the toner showed poor cleanability. The toner of Comparative Example A-2 to which no hydrophobized silica having the primary particle diameter of 120 nm was added as an external additive showed excellent fixability, however, was poor in transferring rate and cleanability. The toner of Comparative Example A-3 having a high number average diameter of inorganic fine particles of 310 nm showed excellent cleanability, however, was poor in transferring dust, fixability, particularly low-temperature image-fixing properties was poor. The toner of Comparative Example A-4 having a low average circularity, showing a high A/S value of 47.1% and being formed in an indefinite shape did not show transferring dust, however, showed a low transferring rate and poor image quality level. The toner had excellent cleanability, however, in particular the low-temperature fixability was poor. The toners of Comparative Examples A-1 and A-4 respectively satisfied a relation of ratio (L/M) of the long axis L and the minor axis M being L/M≦3 in the contact surface portion where each of these toners contacted with a latent image carrier.

Example B-1

Synthesis of Organic Fine Particle Emulsion

To a reaction vessel provided with a stirrer and a thermometer, 683 parts by mass of water, 11 parts by mass of sodium salt of the sulfuric acid ester of methacrylic acid ethylene oxide adduct (ELEMINOL RS-30, manufactured by Sanyo Chemical Industries. Ltd.), 80 parts by mass of styrene, 83 parts by mass of methacrylic acid, 110 parts by mass of butyl acrylate, 12 parts by mass of butyl thioglycollate, and 1 part by mass of ammonium persulphate were poured, and stirred at 400 rpm for 15 minutes to obtain a white emulsion. The white emulsion was heated, the temperature in the system was raised to 75° C. and the reaction was performed for 5 hours. Next, 30 parts by mass of an aqueous solution of 1% by mass ammonium persulphate was added, and the reaction mixture was matured at 75° C. for 5 hours to obtain an aqueous dispersion liquid of a vinyl resin (copolymer of styrene-methacrylic acid-butyl acrylate-sodium salt of the sulfuric acid ester of methacrylic acid ethylene oxide adduct). This aqueous solution was taken as particulate emulsion 1. The volume average particle diameter of particulate emulsion 1 measured by a laser diffraction particle size distribution analyzer (LA-920, manufactured by SHIMADZU Corp.) was 120 nm. After drying part of particulate emulsion 1 and isolating the resin, the glass transition temperature (Tg) of the resin was 72° C. and the mass average molecular mass was 30,000.

Preparation of Aqueous Phase

To 990 parts by mass of water, 83 parts by mass of particulate emulsion 1, 37 parts by mass of a 48.5% by mass aqueous solution of sodium dodecyl diphenylether disulfonic acid (ELEMINOL MON-7, manufactured by Sanyo Chemical Industries, Ltd.) and 90 parts by mass of ethyl acetate were mixed and stirred together to obtain a milky liquid. This was taken as aqueous phase 1.

Synthesis of Low Molecular Mass Polyester

In a reaction vessel equipped with a condenser tube, a stirrer, and a nitrogen inlet tube, 229 parts by mass of bisphenol A ethylene oxide dimolar adduct, 529 parts by mass of bisphenol A propylene oxide trimolar adduct, 208 parts by mass of terephthalic acid, 46 parts by mass of adipic acid and 2 parts by mass of dibutyl tin oxide were placed, and the reaction was performed under normal pressure at 230° C. for 8 hours, and the reaction was further performed under a reduced pressure of 10 mmHg to 15 mmHg for 5 hours, then 44 parts by mass of anhydrous trimellitic acid was poured into the reaction vessel, and the reaction was performed at 180° C. under normal pressure for 2 hours to obtain a polyester. This polyester was taken as low-molecular mass polyester 1. Low-molecular mass polyester 1 had a number average molecular mass of 2,500, a mass average molecular mass of 6,700, a glass transition temperature (Tg) of 43° C. and an acid value of 25.

Synthesis of Intermediate Polyester

Into a reaction vessel equipped with a condenser tube, a stirrer and a thermometer, 682 parts by mass of bisphenol A ethylene oxide dimolar adduct, 81 parts by mass of bisphenol A propylene oxide dimolar adduct, 283 parts by mass of terephthalic acid, 22 parts by mass of anhydrous trimellic acid, and 2 parts by mass of dibutyl tin oxide were placed, and the reaction was performed under normal pressure at 230° C. for 8 hours, and the reaction was further performed under a reduced pressure of 10 mmHg to 15 mmHg for 5 hours to obtain a polyester. This polyester was taken as intermediate polyester 1. Intermediate polyester 1 had a number average molecular mass of 2,100, a mass average molecular mass of 9,500, a glass transition temperature (Tg) of 55° C., an acid value of 0.5 and a hydroxyl value of 51.

Next, 410 parts by mass of intermediate polyester 1, 89 parts by mass of isohorone diisocyanate and 500 parts by mass of ethyl acetate were placed in a reaction vessel equipped with a condenser tube, a stirrer, and a nitrogen inlet tube, and the reaction was performed at 100° C. for 5 hours to obtain a reactant. This was taken as prepolymer 1. The free isocyanate % by mass of prepolymer 1 was 1.53%.

Synthesis of Ketimine

Into a reaction vessel equipped with a stirrer and a thermometer, 170 parts by mass of isohorone diamine and 150 parts by mass of methyl ethyl ketone were poured, and the reaction was performed at 50° C. for 5 hours to obtain a ketimine compound. This was taken as ketimine compound 1. The amine value of ketimine compound 1 was 418.

Synthesis of Masterbatch

To 1,200 parts by mass of water, 540 parts by mass of carbon black (Printex35, manufactured by Degussa AG) (DBP oil absorption amount=42 ml/100 mg, pH=9.5) and 1,200 parts by mass of polyester resin (RS801, manufactured by Sanyo Chemical Industries. Ltd.) were added and mixed in HENSCHEL MIXER (manufactured by MITSUI MINING CO., LTD.) then the mixture was kneaded at 150° C. for 30 minutes using two rollers, extrusion cooled and crushed with a pulverizer to obtain a masterbatch. This was taken as Bk masterbatch 1.

Preparation of Oil Phase

Into a vessel equipped with a stirrer and thermometer, 500 parts by mass of low-molecular mass polyester 1 (polyester resin, RS801, manufactured by Sanyo Chemical Industries, Ltd.), 30 parts by mass of carnauba wax, and 850 parts by mass of ethyl acetate were poured, and the temperature was raised to 80° C. with stirring, maintained at 80° C. for 5 hours, and cooled to 30° C. in 1 hour. In the vessel, the wax was dispersed using a bead mill (Ultra Visco Mill, manufactured by AIMEX CO., LTD.) under the conditions of a liquid feed rate 1 kg/hr, disk circumferential speed of 6 m/s, 0.5 mm zirconia beads filled at 80% by volume, and the dispersion of wax was performed 3 times. Next, 110 parts by mass of Bk masterbatch 1 and 500 parts by mass of ethyl acetate were poured into the vessel, and mixed for 1 hour to obtain a solution. This was taken as Bk initial material solution.

To a vessel, 900 parts by mass of Bk initial material solution were transferred, and 50 parts by mass of ethyl acetate and 165 parts by mass of methyl ethyl ketone were added and dispersed using the bead mill under the conditions of liquid feed rate 1 kg/hr, disk circumferential speed of 8 m/s, 0.5 mm zirconia beads filled at 80% by volume, and the dispersion of wax was performed 3 times to obtain a dispersion liquid. This was taken as Bk pigment-wax dispersion liquid. To 100 parts by mass of Bk pigment-wax dispersion liquid, 25 parts by mass of a filler (Organo Silicasol MEK-ST-UP, ER=20%, the number average particle diameter of the primary particles=12 nm, manufactured by NISSAN CHEMICAL INDUSTRIES, LTD.) were added and mixed in a TK homomixer to obtain a reaction mixture. The mixture was taken as Bk oil phase. The rotation speed of the mixer is preferably 5,000 rpm to 12,000 rpm, and the mixing time is preferably 5 minutes to 20 minutes.

In Example B-1, the mixing is to be carried out with a TK homomixer at a rotation speed of 6,500 rpm for 10 minutes at a temperature of 25° C.

Emulsification, Solvent Removal, Transformation of Toner Particles 120 parts by mass of Bk oil phase, 20 parts by mass of prepolymer 1, and 1.2 parts by mass of ketimine compound 1 were mixed to obtain preparation liquid 1 of resin and colorant having a 50% by mass solid content concentration. To 200 parts by mass of aqueous phase 1, 150 parts by mass of preparation liquid 1 of resin and colorant were added and mixed at 12,000 rpm for 25° C. for 1 minute by a TK homomixer (manufactured by TOKUSHU KIKA KOGYO CO., LTD.) to obtain emulsified dispersion liquid (1). Bk oil phase is preferably used for emulsification within 12 hours after preparation of the Bk oil phase.

To a stainless-steel-Kolben of helical ribbon type with a 3-step stirring fan, 100 parts by mass of Emulsified dispersion liquid (1) were transferred, and the solvent of ethyl acetate was removed with stirring at 60 rmm under reduced pressure (10 kPa) at 25° C. for 6 hours until the ethyl acetate concentration in the emulsified liquid became 5% by mass to obtain a emulsified dispersion liquid (Y-1).

To the emulsified dispersion liquid (Y-1), 3.1 parts by mass of carboxymethyl cellulose (Cellogen HH, manufactured by Daiichi Kogyo Seiyaku Co., Ltd.) were added to improve viscosity, and the solvent of ethyl acetate was removed with stirring at 300 rpm to give its share under reduced pressure (10 kPa) until the ethyl acetate concentration in the emulsified liquid was decreased to 3% by mass. The rotation speed was further decreased to 60 rpm to remove the solvent until the ethyl acetate concentration was further decreased to 1% by mass to obtain dispersion slurry 1. The viscosity of the emulsified liquid after improving the viscosity was 25,000 mPa·s.

Rinsing to Drying

After filtering 100 parts by mass of dispersion slurry 1 under reduced pressure, (1) 100 parts by mass of ion exchange water were added to the filter cake, mixed in a TK homomixer at a rotation speed of 12,000 rpm for 10 minutes and filtered.

(2) 100 parts by mass of 0.1% by mass sodium hydroxide solution were added to the filter cake of (1), mixed in a TK homomixer at a rotation speed of 12,000 rpm for 30 minutes and filtered under reduced pressure.

(3): 100 parts by mass of 0.1% by mass hydrochloric acid were added to the filter cake of (2), mixed in a TK homomixer at a rotation speed of 12,000 rpm for 10 minutes and filtered.

(4): 300 parts by mass of iron exchange water were added to the filter cake of (3), mixed in a TK homomixer at a rotation speed of 12,000 rpm for 10 minutes, and filtered twice to obtain filter cake 1.

Filter cake 1 was dried in a circulating air dryer at 45° C. for 48 hours, and then sieved through a sieve of 75 μm mesh to obtain toner-base particles having a volume average particle diameter of 5.0 μm and a fine particle content of 3.17 μm or less being 14% by number of pieces. This was taken as toner-base particles 1.

Addition of External Additives

To 100 parts by mass of the obtained toner-base particles 1, 2 parts by mass of hydrophobized silica (HDKH200, manufactured by Clariant Japan K.K., the number average particle diameter of the primary particles=30 nm) and 1 part by mass of inorganic oxide particles 1 (the number average particle diameter of the primary particles=120 nm, and 1 part by mass of titanium oxide (MT-150A, manufactured by Teika K.K., the number average particle diameter of the primary particles=30 nm) were mixed in an Oster mixer at 12,000 rpm for 1 minute and then sieved through a sieve of 75 μm mesh to obtain a toner. This was taken as toner 1. The thickness of the filler-layer in the toner was 0.01 μm to 0.2 μm.

Comparative Example B-1

Toner base particles were prepared in the same manner as Example B-1, provided that in the preparation of an oil phase, 25 parts by mass of inorganic fine particles (Organo Silicasol MEK-ST-UP, ER=20%, the number average particle diameter of the primary particles=12 nm, manufactured by NISSAN CHEMICAL INDUSTRIES, LTD.) were added and mixed in a TK homomixer under the conditions of the rotation speed of the mixer 12,000 rpm; mixing time for 25 minutes; and mixing temperature 28° C.

In Example B-1, the mixing is to be carried out with a TK homomixer at a rotation speed of 6,500 rpm for 10 minutes at a temperature of 25° C.

Addition of External Additives

To 100 parts by mass of the obtained toner-base particles 1, 2 parts by mass of hydrophobized silica (HDKH200, manufactured by Clariant Japan K.K., the number average particle diameter of the primary particles=30 nm) and 1 part by mass of inorganic oxide particles 1 (the number average particle diameter of the primary particles=120 nm, and 1 part by mass of titanium oxide (MT-150A, manufactured by Teika K.K., the number average particle diameter of the primary particles=30 nm) were mixed in an Oster mixer at 12,000 rpm for 1 minute and then sieved through a sieve of 75 μm mesh to obtain a toner.

Preparation of Two-Component Developer

When image quality or the like of the copied images were evaluated in the Examples and Comparative Examples, the performance of the toner of the present invention was evaluated as a two-component developer.

As carrier C-1 used in the two-component developer, ferrite carriers which were coated with a silicone resin with the average thickness of 0.5 μm to have the average particle diameter of 35 μm were used. In a vessel, 7 parts by mass of the toner was used relative to 100 parts by mass of the carrier particles and mixed using a tabular mixer with a vessel being upset to stir the mixtures therein to be uniformly mixed and charged to thereby produce the carrier C-1.

Carrier C-1 was Prepared as Follows:

As a core material 5,000 parts of Mn ferrite particles having a mass average particle diameter of 35 μm were prepared. As coating materials, 450 parts by mass of toluene, 450 parts by mass of silicone resin SR2400 (nonvolatile matter content of 50%, manufactured by Dow Corning Toray Silicone Co., Ltd.), 10 parts by mass of amino silane SH6020 (manufactured by Dow Corning Toray Silicone Co., Ltd.), and 10 parts by mass of carbon black were prepared and dispersed with a stirrer for 10 minutes to prepare a coating solution. The core material and the coating solution were placed in a coating apparatus in which placed materials were coated while giving rotational flow by equipped rotatable bottom plate disk and stirring fans in a fluidized bed to coat the coating solution on the core material. The obtained coated material was calcined in an electrical furnace at 250° C. for 2 hours to thereby obtain carrier C-1.

Evaluation Method (Evaluation Items)

(1) Amount of Charge

To an exclusively used gauge, 7 parts by mass of toner-base particles and 93 parts by mass of magnetic carriers in a particle diameter of 35 μm produced by Ricoh Company, Ltd. were placed at room temperature and stirred with a stirring apparatus exclusively used for the purpose at 280 rpm, and the amount of charge was measured using a blowoff unit. The stirring was performed for 15 seconds, 600 seconds, and 1,800 seconds, and the respective amounts of charge were defined as TA15 (−μC/g), TA600(−μC/g), and TA1,800 (−μC/g), respectively, in which the number following TA respectively represent the time of seconds for stirring magnetic carriers and toner (2) Charge Build-Up Properties In the measurement of the amount of charge obtained in the item (1), a toner having a value of TA15 being 26 or more was evaluated as A, a toner having a value of TA15 being 22 to 25 was evaluated as B, a toner having a value of TA15 being 18 to 21 was evaluated as C, and a toner having a value of TA15 being 17 or less was evaluated as D. With respect to charge temporal stability, a toner having a value of TA1,800-TA600 being 2 or less was evaluated as A, a toner having a value of TA1,800-TA600 being 3 to 4 was evaluated as B, a toner having a value of TA1,800-TA600 being 5 to 8 was evaluated as C, and a toner having a value of TA1,800-TA600 being 9 or more was evaluated as D.

3) Cleanability

After outputting 100 sheets of paper using a printer as an evaluation system (IPSiO8000, manufactured by Ricoh Company, Ltd.), transfer residual toner remaining on the photoconductor which had gone through a cleaning step was transferred to a sheet of white paper using a scotch tape (manufactured by Sumitomo 3M Ltd.) to measure the reflection density by a reflection densitometer (Macbeth reflection densitometer RD514). A toner which had a difference in reflection density from that of the blank portion of the paper being less than 0.005 was evaluated as A, a toner which had a difference thereof being 0.005 to 0.010 was evaluated as B, a toner which had a difference thereof being 0.011 to 0.02 was evaluated as C, and a toner which had a difference thereof being more than 0.02 was evaluated as D.

(4) Evaluation of LL Background Smear

Running output of 10,000 sheets of a 50% image-area ratio chart in monochrome mode was performed under normal temperature and relative humidity by using an evaluation system (IPSiO8000, manufactured by Ricoh Company, Ltd.) and running output of 20,000 sheets was then performed in the LL environment at 10° C. and 15% RH (Relative Humidity) in the same manner stated above. Then, an image on a sheet of white paper was stopped during a developing step, the residual developer remaining on the photoconductor which had gone through a developing step was transferred to a sheet of white paper using a scotch tape, and the difference in image density between a developer-transferred tape and a developer-not-transferred tape was measured using a spectrodensitrometer 938 (manufactured by X-Rite Inc.). The lesser the difference in image density thereof is, the better the result of background smear, and toners rank higher in the order of D, C, B, and A.

Table 3 shows respective properties of the used toners, and Table 4 shows evaluation results of these toners.

(Evaluation Items)

1) Existence Ratio of Inorganic Fine Particles of $X_{surf}$ and $X_{total}$

In a vessel 67% by mass of the toner was dispersed in a sucrose-saturated aqueous solution and frozen at −100° C., and then sliced so as to have a wall thickness of 1,000 angstrom using a cryomicrotome (EM-FCS, manufactured by Laica). Pictures of the cross-sectional surfaces of toner particles were taken at 10,000-fold magnification using a transmission electron microscope (JEM-2010, manufactured by JEOL Ltd.). Using an image analyzer (nexus New CUBE ver. 2.5, manufactured by NEXUS Co., Ltd.), in a cross-sectional surface of a toner particle where the cross-sectional area of the toner particle was maximum, the area ratio of shadows of inorganic fine particles in the region of 200 nm in a direction perpendicular to the toner particle from the surface was taken, i.e. $X_{surf}$ was obtained. In addition, the area ratio of shadows of inorganic fine particles in the total area of the cross-sectional area of the toner particle, i.e. $X_{total}$ was obtained. Ten toner particles were selected at random and measured respectively. The average value of these ten toner particles was taken to be the measured values as $X_{surf}$ and $X_{total}$.

2) SF-1 and SF-2

The toner was magnified at 500-fold magnification using a scanning electron microscope (S-4200, manufactured by Hitachi, Ltd.) at an acceleration voltage of 5 kV to select 100 pieces of toner particle images. The image information was analyzed by an image analyzer (nexus New CUBE ver. 2.5, manufactured by NEXUS Co., Ltd.) to obtain the shape factor SF-1. In the same manner as above, 50 pieces of toner particle images magnified at 3,500-fold magnification were selected at random using the scanning electron microscope, and the image information was analyzed by an image analyzer (nexus New CUBE ver. 2.5, manufactured by NEXUS Co Ltd.) to obtain the shape factor SF-2.

3) Si-Surface Concentration and F-Surface Concentration

The concentration of silicon element and the concentration of fluorine element on surfaces of toner base particles were measured using an X-ray photoelectron spectrometer (1600S manufactured by Philips Electronics NV). The toner base particles were placed in an aluminum tray and the tray was attached to a sample holder with a carbon sheet to measure the concentrations using an X-ray source of MgKα X-rays at 400 W within an analysis area of 0.8×2.0 mm.

4) Average Circularity

In a vessel 0.2 g of the toner and 0.2 ml of a surface active surfactant were added to 100 ml of distilled water and dispersed adequately using an ultrasonic dispersing apparatus.

The toner dispersion liquid was measured using a flow-particle-image analyzer (FPIA-2000; manufactured by Sysmex Corp.). The average circularity was measured within an area of a toner particle diameter from 0.6 μm to 400 μm

TABLE 3

| | $X_{surf}$ | $X_{total}$ | SF-1 | SF-2 | F atomic % | Si atomic % | Circularity |
|---|---|---|---|---|---|---|---|
| Ex. B-1 | 89% | 40% | 130 | 135 | 3.6 | 5.7 | 0.94 |
| Compara. Ex. B-1 | 35% | 42% | 128 | 130 | 1.2 | 0.9 | 0.96 |

TABLE 4

| | TA15 (-μC/g) | TA600 (-μC/g) | TA1,800 (-μC/g) | Charge build-up properties | Charge temporal stability | Cleanability | Background smears under LL environment |
|---|---|---|---|---|---|---|---|
| Ex. B-1 | 29 | 31 | 32 | Excellent | Excellent | Excellent | Excellent |
| Compara. Ex. B-1 | 17 | 26 | 19 | Poor | Passable | Excellent | Poor |

In the toner according to Example B-1, a filler is poured in the last step of an oil phase preparation process, and the rotation speed of a mixer and rotation time in the step of mixing these materials are set within the above-mentioned ranges to thereby control the conditions of toner dispersion. These arrangements enable filler to uniformly reside in the vicinity of a surface of a toner particle and to prevent occurrences of variability in fine particle content between toner particles.

As shown in Table 4, for the toner obtained in Example B-1, it was possible to obtain excellent results without any background smears, because the toner has a high amount of charge, excellent charge build-up properties represented by TA15, and an amount of charge with the lapse of time is highly stable.

On the other hand, the toner obtained in Comparative Example B-1 was not sufficiently deformed and poor in cleanability and the toner had a charge amount lower than that of Example B-1, was inferior in charge build-up properties and temporal stability of an amount of charge compared to those of Example B-1, and demonstrated background smears under a low-temperature and low-humidity environment.

The invention claimed is:

1. A toner comprising:

a binder resin;

toner-base particles containing an inorganic filler, and inorganic fine particles, wherein the toner is obtained by adding, into an aqueous medium, a toner material liquid in which at least the binder resin and the inorganic filler are dispersed and/or dissolved in an organic solvent, so that the toner material liquid is emulsified, and removing the organic solvent therefrom, wherein the filler is contained in a filler-layer in the vicinity of a surface of the toner-base particles, a number average particle diameter of the primary particles of the inorganic fine particles is 90 nm to 300 nm, and the average circularity of the toner is 0.94 or more, and wherein a filler-existence ratio $X_{surf}$ of the filler which exists in a region from the surface to a depth of 200 nm from the surface of the toner base particles and an average filler-existence ratio $X_{total}$ of the filler present in a total content of the toner base particles satisfy an inequality of $X_{surf}>X_{total}$.

2. The toner according to claim 1, wherein a part of the filler exists in a state being exposed on a surface of the toner.

3. The toner according to claim 1, wherein a content of the filler in the toner is 0.01% by mass to 20% by mass.

4. The toner according to claim 1, wherein a ratio of a volume average particle diameter of the primary particles of the filler to a volume average particle diameter of the toner is 0.1 or less.

5. The toner according to claim 1, wherein a volume average particle diameter of the primary particles of the filler is 0.001 μm to 0.5 μm.

6. The toner according to claim 1, wherein the inorganic filler comprises one selected from the group consisting of metallic oxides, metallic hydroxides, metallic carboxylates, metallic sulfate, metallic silicates, metallic nitrides, metallic phosphates, metallic borates, metallic titanates, metallic sulfides, and carbons.

7. The toner according to claim 1, wherein the filler comprises any one of silica, alumina, and titania.

8. The toner according to claim 7, wherein the filler comprises a silica, having a silicon content of a surface of the silica according to X-ray photoemission spectroscopy is 0.5 atomic % to 10 atomic %.

9. The toner according to claim 1, wherein the surface of the filler is subjected to a surface treatment with at least one selected from the group consisting of silane coupling agents, titanate coupling agents, alminate coupling agents, and tertiary amine compounds.

10. The toner according to claim 1, wherein the filler has a hydrophobicization degree of 15% to 55%.

11. The toner according to claim 1, wherein the inorganic fine particles comprise a silica formed in a spherical shape.

12. The toner according to claim 1, wherein the inorganic fine particles are produced by a sol-gel process.

13. The toner according to claim 1, wherein the toner is obtained by dispersing the toner in an aqueous medium in which the dispersed toner is subjected to a surface treatment with a fluorine-containing quaternary ammonium salt.

14. The toner according to claim 13, wherein the toner has a fluorine atom content of the fluorine-containing compound being from 2.0 atomic % to 15 atomic % according to X-ray photoemission spectroscopy.

15. The toner according to claim 1, wherein a charge-controlling agent is externally added to the toner-base particles.

16. The toner according to claim 15, wherein the charge-controlling agent is externally added to the toner-base particles by a wet process.

17. The toner according to claim 1 further comprising a wax.

18. The toner according to claim 1, wherein the binder resin comprises a modified polyester (i).

19. The toner according to claim 18, wherein the toner comprises an unmodified polyester (ii) as well as the modified polyester (i) and has a mass ratio of the modified polyester to the unmodified polyester is 5/95 to 80/20.

20. The toner according to claim 1, wherein the toner-base particles are produced by dispersing and dissolving toner materials comprising a polyester prepolymer having at least a functional group containing a nitrogen atom, a polyester, and a filler in an organic solvent, and further dispersing the toner materials in an aqueous medium, and subjecting at least the polyester prepolymer to a cross-linking and/or an elongation reaction.

21. The toner according to claim 1, wherein the toner has a shape factor SF-1 of 110 to 140, a shape factor SF-2 of 120 to 160, and a ratio Dv/Dn of a volume average particle diameter (Dv) to a number average particle diameter (Dn) being 1.01 to 1.40.

22. The toner according to claim 1, wherein the toner is a full-color image-forming toner used for an image-forming apparatus, in which color-images formed on a latent image carrier are sequentially transferred onto an intermediate transferring member and then transferred onto a recording medium in block to fix the color images and to form a full-color image.

23. A developer for developing a latent electrostatic image formed on a latent image carrier, wherein the developer is a two-component developer which comprises a toner and carrier; and the toner comprises at least a binder resin, toner-base particles containing an inorganic filler, and inorganic fine particles;

wherein the toner is obtained by adding, into an aqueous medium, a toner material liquid in which at least the binder resin and the inorganic filler are dispersed and/or dissolved in an organic solvent, so that the toner material liquid is emulsified, and removing the organic solvent therefrom, wherein the filler is contained in a filler-layer in the vicinity of a surface of the toner-base particles, a number average particle diameter of the primary particles of the inorganic fine particles is 90 nm to 300 nm, and the average circularity of the toner is 0.94 or more; and wherein a filler-existence ratio $X_{surf}$ of the filler which exists in a region from the surface to a depth of 200 nm from the surface of the toner base particles and an average filler-existence ratio $X_{total}$ of the filler present in a total content of the toner base particles satisfy an inequality of $X_{surf}>X_{total}$.

24. A process cartridge comprising:

a latent image carrier, and a developing unit, wherein the latent image carrier is configured to carry a latent image, the developing unit is configured to develop the latent electrostatic image formed on the surface of the latent image carrier into a visible image by supplying a toner to the latent electrostatic image, and the latent image carrier and the developing unit are formed in a singled body and detachably mounted to the main body of an image-forming apparatus, and wherein the toner comprises at least a binder resin, toner-base particles containing an inorganic filler, and inorganic fine particles;

wherein the toner is obtained by adding, into an aqueous medium, a toner material liquid in which at least the binder resin and the inorganic filler are dispersed and/or dissolved in an organic solvent, so that the toner material liquid is emulsified, and removing the organic solvent therefrom, wherein the filler is contained in a filler-layer in the vicinity of a surface of the toner-base particles, a number average particle diameter of the primary particles of the inorganic fine particles is 90 nm to 300 nm, and the average circularity of the toner is 0.94 or more; and wherein a filler-existence ratio $X_{surf}$ of the filler which exists in a region from the surface to a depth of 200 nm from the surface of the toner base particles and an average filler-existence ratio $X_{total}$ of the filler present in a total content of the toner base particles satisfy an inequality of $X_{surf}>X_{total}$.

25. An image-forming apparatus comprising:

a latent image carrier configured to carry a latent image, a charging unit configured to uniformly charge a surface of the latent image carrier, an exposing unit configured to expose the charged surface of the latent image carrier based on image data to form a latent electrostatic image on the latent image carrier, a developing unit configured to develop the latent electrostatic image formed on the surface of the latent image carrier into a visible image by supplying a toner to the latent electrostatic image, a transferring unit configured to transfer the visible image on the surface of the latent image carrier to a recording medium, and a fixing unit configured to fix the visible image on the recording medium, wherein the toner comprises at least a binder resin, toner-base particles containing an inorganic filler, and inorganic fine particles;

wherein the toner is obtained by adding, into an aqueous medium, a toner material liquid in which at least the binder resin and the inorganic filler are dispersed and/or dissolved in an organic solvent, so that the toner material liquid is emulsified, and removing the organic solvent therefrom, wherein the filler is contained in a filler-layer in the vicinity of a surface of the toner-base particles, a number average particle diameter of the primary particles of the inorganic fine particles is 90 nm to 300 nm, and the average circularity of the toner is 0.94 or more; and wherein a filler-existence ratio $X_{surf}$ of the filler which exists in a region from the surface to a depth of 200 nm from the surface of the toner base particles and an average filler-existence ratio $X_{total}$ of the filler present in a total content of the toner base particles satisfy an inequality of $X_{surf}>X_{total}$.

26. An image-forming method comprising:

charging a surface of a latent image carrier uniformly, exposing the charged surface of the latent image carrier based on image data to form a latent electrostatic image on the latent image carrier, developing the latent electrostatic image formed on the surface of the latent image carrier into a visible image by supplying a toner to the latent electrostatic image, transferring the visible image on the surface of the latent image carrier to a recording medium, and fixing the visible image on the recording medium, wherein the toner comprises at least a binder resin, toner-base particles containing an inorganic filler, and inorganic fine particles;

wherein the toner is obtained by adding, into an aqueous medium, a toner material liquid in which at least the binder resin and the inorganic filler are dispersed and/or dissolved in an organic solvent, so that the toner material liquid is emulsified, and removing the organic solvent therefrom, wherein the filler is contained in a filler-layer in the vicinity of a surface of the toner-base particles, a number average particle diameter of the primary particles of the inorganic fine particles is 90 nm to 300 nm, and the average circularity of the toner is 0.94 or more; and wherein a filler-existence ratio $X_{surf}$ of the filler which exists in a region from the surface to a depth of 200 nm from the surface of the toner base particles and an average filler-existence ratio $X_{total}$ of the filler present in a total content of the toner base particles satisfy an inequality of $X_{surf}>X_{total}$.

27. The toner according to claim 1, wherein the filler is added, as an organosol in a dispersed state, into the toner material liquid.

28. The toner according to claim 1, wherein assuming that a total projected area of the toner is represented as S, and a total area of portions of the toner in contact with a latent image bearing member is represented as A, a ratio of A/S of the total area A to the total projected area of the toner S is 15% to 40%.

* * * * *